US007242895B2

(12) United States Patent
Inada et al.

(10) Patent No.: US 7,242,895 B2
(45) Date of Patent: Jul. 10, 2007

(54) IMAGE HEATING APPARATUS HAVING A FLEXIBLE SLEEVE

(75) Inventors: Seiji Inada, Susono (JP); Fumiki Inui, Mishima (JP); Atsushi Iwasaki, Mishima (JP); Toshiki Nagase, Sunto-gun (JP); Takehiko Suzuki, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 11/056,975

(22) Filed: Feb. 14, 2005

(65) Prior Publication Data

US 2005/0185994 A1 Aug. 25, 2005

(30) Foreign Application Priority Data

Feb. 20, 2004 (JP) ..... 2004-044504

(51) Int. Cl.
*G03G 15/20* (2006.01)

(52) U.S. Cl. ..... 399/328; 219/216

(58) Field of Classification Search ..... 399/328, 399/329, 320; 347/156; 219/216
See application file for complete search history.

(56) References Cited

U.S. PATENT DOCUMENTS

| | | | | |
|---|---|---|---|---|
| 5,508,796 | A | 4/1996 | Sasame et al. | 399/18 |
| 5,539,507 | A | 7/1996 | Miyashiro et al. | 399/298 |
| 5,543,904 | A | 8/1996 | Kato et al. | 399/335 |
| 5,580,042 | A | 12/1996 | Taniguro et al. | 271/274 |
| 5,620,174 | A | 4/1997 | Taniguro et al. | 271/10.12 |
| 6,088,567 | A | 7/2000 | Miyashiro et al. | 399/400 |
| 6,151,462 | A | 11/2000 | Fukuzawa et al. | 399/67 |
| 6,168,270 | B1 | 1/2001 | Saikawa et al. | 347/104 |
| 6,671,488 | B2 | 12/2003 | Izawa et al. | 399/329 |
| 6,731,903 | B2 | 5/2004 | Suzuki | 399/361 |
| 2003/0185604 | A1 * | 10/2003 | Sato | 399/329 |
| 2004/0120740 | A1 * | 6/2004 | Uekawa et al. | 399/329 |
| 2004/0197112 | A1 | 10/2004 | Saito et al. | 399/69 |
| 2005/0180788 | A1 * | 8/2005 | Watanabe et al. | 399/328 |

FOREIGN PATENT DOCUMENTS

| | | |
|---|---|---|
| JP | 63-313182 | 12/1988 |
| JP | 4-44075 | 2/1992 |
| JP | 4-204980 | 7/1992 |
| JP | 5-208750 | 8/1993 |

(Continued)

*Primary Examiner*—Sophia S. Chen
(74) *Attorney, Agent, or Firm*—Fitzpatrick, Cella, Harper & Scinto

(57) ABSTRACT

An object of the present invention is to provide an image heating apparatus having a flexible sleeve of an excellent durability. To this end, an image heating apparatus according to the present invention includes: a flexible sleeve; a driving roller contacting an external periphery surface of the sleeve and serving to rotate the sleeve; a sliding member contacting an internal periphery surface of the sleeve to form a nip portion in cooperation with the driving roller; and a restricting member for restricting a movement of the sleeve in a generatrix direction of the sleeve, wherein, within an edge face of the sleeve in a mounted state on the apparatus, equally bisected by an imaginary plane substantially parallel to a nip plane of the nip portion into a first area closer to the nip portion and a second area farther from the nip portion, the restricting member executes a restricting action only on the second area.

4 Claims, 18 Drawing Sheets

FOREIGN PATENT DOCUMENTS

| | | | |
|---|---|---|---|
| JP | 06-314043 | A * | 11/1994 |
| JP | 07-181827 | A * | 7/1995 |
| JP | 10-10893 | | 1/1998 |
| JP | 11-15303 | | 1/1999 |
| JP | 2002-231419 | | 8/2002 |
| JP | 2003-45615 | | 2/2003 |
| JP | 2003-156954 | | 5/2003 |

* cited by examiner

IMAGE HEATING APPARATUS HAVING A FLEXIBLE SLEEVE

BACKGROUND OF THE INVENTION

1. Field of the Invention

The present invention relates to an image heating apparatus adapted for use as an image heat fixing device in an image forming apparatus such as a copying apparatus or a printer, and more particularly to an image heating apparatus having a flexible sleeve.

2. Related Background Art

Recently, as a heat fixing device to be mounted on a copying apparatus or a printer, there is desired a heat fixing device with a short start-up time to a fixing temperature and with a low total electric power consumption during the printing operation and the waiting state. In order to meet such requests, there is commercialized a heat fixing device utilizing a flexible sleeve (also called a fixing film, a fixing belt or a film) as a sleeve coming into contact with a toner image. Heat fixing devices of film heating type are disclosed for example in Japanese Patent Application Laid-Open Nos. S63-313182, 2003-045615, 2003-156954, H10-10893 and H11-15303. The flexible sleeve employed in the heat fixing device of film heating method may be based on a heat resistant resin such as polyimide or on a metal such as stainless steel having a higher thermal conductivity than the resinous material.

In such heat fixing device of film heating type, a film rotation induces a phenomenon that the film is moved (or biased) in a thrust direction (direction of generatrix), and it is difficult to produce the apparatus free from such movement. Thus, Japanese Patent Application Laid-Open Nos. H04-44075 and H04-204980 disclose a structure of maintaining the film free from a tension as far as possible, thereby suppressing a biasing force of moving the film in the thrust direction. In the apparatus described in these literatures, the film is not driven by a tension roller or a driving roller provided inside the film but by a pressure roller (pressure roller driving method). As it is still difficult to completely eliminate the film movement in the thrust direction even in the apparatus of such pressure roller driving method, flanges are provided in positions corresponding to edge positions of the film in order to restrict the film movement by such flanges.

However, in a configuration of restricting the film movement by the flanges, in case a biasing force of the film in the thrust direction becomes larger than a designed value for example by an influence of tolerance in the components, a large load is applied to the edge portion of the film thereby deteriorating the durability of the film. In particular, as the film is nipped in a nip portion, the film shows a low flexibility in an upstream region and a downstream region of the nip portion in the rotating direction of the film, and the film tends to show a breakage when edge portions of the film in such regions are restricted by the flanges.

In order to avoid such drawbacks, Japanese Patent Application Laid-Open No. H05-208750 proposes a shape of a film restricting face of the flange. FIG. 19 schematically shows an apparatus described in this patent literature. Referring to FIG. 19, there are shown a film 203, a pressure roller 204, a pressure roller driving gear G meshing with an unillustrated motor gear, a flange 202, a film interior inserted portion 202*a* of the flange, a flange face 202*b*, and a pressure spring 205 for forming a nip portion N. The nip portion N is formed between a heater (not shown) inserted into the interior of the film and the pressure roller 204 under the force of the spring 205. The film 203 is nipped, in the nip portion N, between the heater and the pressure roller 204. The film 203 is rotated by a rotation of the pressure roller 204.

As shown in FIG. 19, the flange face 202*b* has a tapered shape at the nip side. Such tapered shape serves not to restrict the edge portion of the film at the upstream and downstream sides of the nip portion, thereby suppressing the deterioration of the durability of the film.

However, a breakage in the edge portion of the fixing film may still occur even when the flange is formed in a tapered shape. FIG. 20 schematically shows a state in which the entire flange 202, for restricting the rotating trajectory of the fixing film 203 and the edge portion thereof in the thrust direction, is somewhat inclined to an outward direction from the thrust direction for example by an assembling tolerance of the flange 202, wherein the fixing film has a biasing force and impinges on the restricting face. In a state shown in FIG. 20, since an outward inclination of the entire flange 202 causes an inclination of the restricting face 202*b* also to the outward direction, the edge portion of the fixing film impinges, by the biasing force, on the restricting face in a localized area closer to the fixing nip portion N (an area indicated by a broken line). It is clarified by the investigation of the present inventors that a breakage is generated in an edge portion of the fixing film in case a strong biasing force is exerted on the fixing film in this state. It is also clarified that, in case the flange 202 is inclined in an outward direction, a breakage is generated by the biasing force also in an upstream or downstream vicinity of the fixing nip portion N by an impingement of the edge portion of the fixing film.

This is principally because the flexibility of the fixing film itself tends to be lost in a vicinity area of the fixing nip portion N in which the fixing film is nipped and a localized impingement of an edge portion of the fixing film on the restricting face of the flange 202 causes a strong stress to such edge portion, and a film breakage is generated in case such stress exceeds a breaking strength of the fixing film.

Particularly in a film (fixing belt) having a metal layer as a base, the fixing belt itself has a high rigidity but, in a process for producing such fixing belt, burrs and small cracks are generated on edge faces thereof in cutting the fixing film into a length suitable for a fixing apparatus and fissures are generated from such burrs and small cracks by a frictional contact in the course of repeated rotations.

In order to prevent such fissures on the edge portions of the fixing belt, Japanese Patent Application Laid-Open No. 2002-231419 discloses a configuration in which a flange, supporting an edge portion of the fixing belt, is supported from an external periphery side of the fixing belt and is made to rotate together with the fixing belt, thereby avoiding a frictional contact between the edge portion of the fixing belt and the fixing apparatus.

FIGS. 21 and 22 are respectively a perspective view and a cross-sectional view, seen from a longitudinal direction, of a configuration in which a fixing flange 300 is supported from the external peripheral side of a fixing belt 301 and is rotated together with the fixing belt 301.

The fixing flange 300 has an internal diameter larger than an external diameter of the fixing belt 301, and the fixing belt 301 is pressed by a pressure roller 302 to cause a deformation, whereby an external peripheral surface of the fixing belt comes into contact with a internal receiving face 300*a* of the fixing flange 300 to generate a frictional force. Such frictional force causes the fixing flange 300 to rotate along the rotation of the fixing belt 301.

The fixing belt 301, being supported by the internal receiving face 300*a,* is prevented from being detached out of the fixing flange 300 even when the fixing belt 301 is moved in the longitudinal direction.

However, the fixing belt 301 in the course of its rotation is deformed by the pressure roller 302 in the vicinity of the fixing nip portion N, repeating motions in the radial direction (indicated by hatched portions a, b in FIG. 23) with respect to the fixing flange 300. Consequently, even though the fixing flange 300 rotates together with the fixing belt 301, a certain frictional contact is unavoidable between the edge portion of the fixing belt 301 and the fixing flange 300.

There is also proposed a configuration, as shown in FIG. 24 in a cross-sectional view seen perpendicularly to the longitudinal direction, in which a fixing flange 303 has a tapered shape toward an end thereof so as to form an angle θ equal to or larger than 90° between a longitudinal extension of the fixing belt 301 and a face of the fixing flange 303 in contact with the edge face of the fixing belt 301 thereby preventing a frictional contact on the edge face of the fixing belt 301 to a certain degree when the fixing belt 301 is deformed in the course of rotation thereof by the pressure roller 302, but a frictional contact in the radical direction between the edge face of the fixing belt 301 and the fixing flange 303 inevitably takes place in areas in the vicinity of the fixing nip portion N where the deformation starts and the deformation is finally restored.

Also in case the fixing belt 301 has a high biasing force, there may be generated a frictional force in a receiving portion of the fixing flange 303 and the fixing flange 303 may not rotate in synchronization with the fixing belt 301. In such situation, since the fixing flange 303 and the fixing belt 301 have different rotating speeds, a relatively strong force is applied to the fixing belt if the fixing flange 303 and the fixing belt 301 are not well mutually slidable. In such case, in case the fixing flange or the fixing belt is inclined to cause a contact therebetween in the vicinity of the nip, a very high buckling pressure is generated to eventually cause a fissure in the fixing belt.

Also in case the angle θ is selected large, the fixing flange 303 is drawn into a direction indicated by an arrow in FIG. 24 by the longitudinal biasing force of the fixing belt 301 to generate a strain in the fixing belt 301 in the longitudinal direction thereof, thereby increasing the stress thereon and resulting in a destruction thereof by fatigue.

Particularly a fixing belt 301 prepared by a plastic working such as stroking has a large retentive stress in the metal layer, and tends to cause a fissure starting from a small crack on the edge face of the fixing belt or a destruction by fatigue, by a frictional contact on the edge face or by a strain in the longitudinal direction.

In particular, a color image forming apparatus requires a higher pressure in the fixing nip portion N in comparison with a monochromatic image forming apparatus. This is because, since a color image is formed by superposing toners of plural colors and the height of the toner image becomes higher than in the monochromatic image forming apparatus, a higher pressure is required for forming a uniformly smooth image in the fixing portion.

However, a larger pressure in the fixing nip portion N increases the biasing force of the fixing belt in the longitudinal direction, thereby facilitating the fissure formation by the buckling of the fixing belt.

SUMMARY OF THE INVENTION

The present invention has been made in consideration of the aforementioned drawbacks, and an object of the present invention is to provide an image heating apparatus having a flexible sleeve of an excellent durability.

Another object of the present invention is to provide an image heating apparatus including:

a flexible sleeve;

a driving roller contacting an external periphery surface of the sleeve and serving to rotate the sleeve;

a sliding member contacting an internal periphery surface of the sleeve to form a nip portion in cooperation with the driving roller; and a restricting member for restricting a movement of the sleeve in a generatrix direction of the sleeve;

wherein, within an edge face of the sleeve in a mounted state on the apparatus, equally bisected by an imaginary plane substantially parallel to a nip plane of the nip portion into a first area closer to the nip portion and a second area farther-from the nip portion, the restricting member executes a restricting action only on the second area.

Still other objects of the present invention will become fully apparent from the following detailed description which is to be taken in conjunction with the accompanying drawings.

DETAILED DESCRIPTION OF THE PREFERRED EMBODIMENTS

Embodiment 1

(1) Example of Image Forming Apparatus

Figure 1:
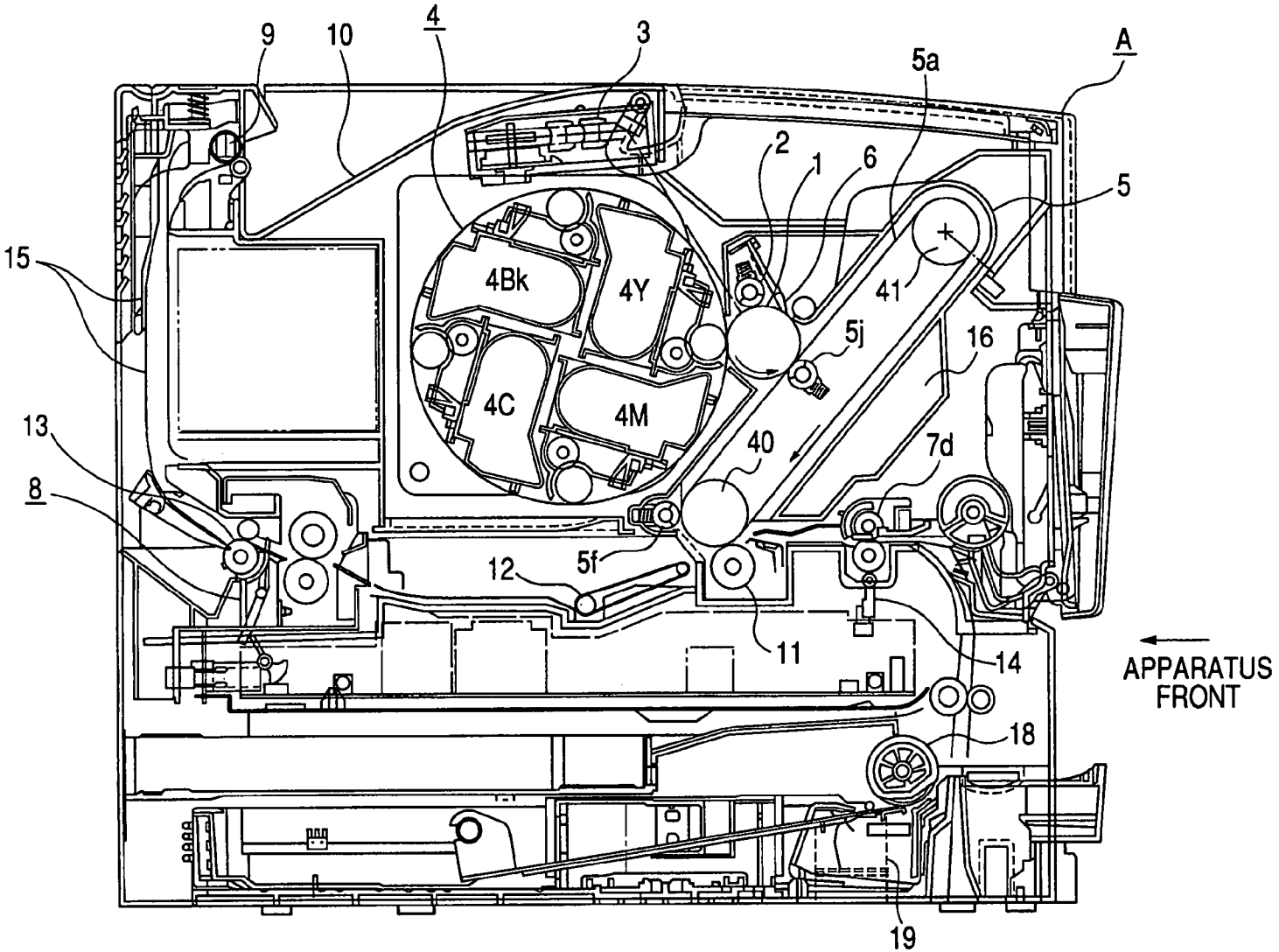
FIG. 1 is a schematic view showing a configuration of an image forming apparatus in an embodiment 1.

FIG. 1 is a schematic view showing a configuration of an image forming apparatus utilizing an image heating apparatus of the present invention as a fixing apparatus. The image forming apparatus of the present embodiment is a four-colored full-color laser beam printer utilizing an electrophotographic process.

a) Entire Structure of Image Forming Apparatus

The present image forming apparatus A is provided, as an image forming-portion, for example with a photosensitive drum 1 serving as an image bearing member, a charging apparatus for charging the photosensitive drum 1, an exposure apparatus (laser scanner) 3 for executing an exposure on the photosensitive drum 1 for forming an electrostatic latent image thereon, a rotary developing device holder 4 which supports four developing devices, namely a yellowing developing device 4Y, a magenta developing device 4M, a cyan developing device 4C and a black developing device 4Bk for developing the electrostatic latent image into a toner image, an intermediate transfer member unit 5, and a drum cleaning unit (cleaning blade) 6 for cleaning a surface of the photosensitive drum 1.

The intermediate transfer member unit 5 is constituted, for example, of a intermediate transfer belt 5*a*, a driving roller 40 and a tension roller 41 for supporting the intermediate transfer belt 5*a* under a tension, a primary transfer roller 5*j* for pressing the intermediate transfer belt 5*a* to the photosensitive drum 1 thereby forming a primary transfer portion, and a secondary transfer roller 11 and a charging roller 5*f* serving as a belting cleaning unit, which are respectively contacted with or separated from an external surface of the intermediate transfer belt 5*a* in a portion thereof wound on the driving roller 40.

Also a sheet feeding portion is constituted for example of a sheet cassette 19 containing a stack of recording materials (not shown) as final recording media, a feeding roller 18 and a registration sensor 14, and a fixing/discharging portion for the recording material after image formation is constituted for example of an on-demand fixing apparatus 8, paired conveying rollers 13, a discharge guide 15, paired discharge rollers 9 and a discharge tray 10.

The intermediate transfer belt 5*a* is rotated clockwise, as indicated by an arrow, with a predetermined peripheral speed, while the photosensitive drum 1 is rotated counterclockwise, as indicated by an arrow, in synchronization with the rotation of the intermediate transfer belt 5*a*. The surface of the photosensitive drum 1 is uniformly. charged by the charging apparatus 2, then subjected to a light irradiation by the exposure apparatus 3 corresponding to an yellow (Y) image whereby an electrostatic latent image corresponding to the yellow image is formed on the photosensitive drum 1.

Simultaneously with the formation of the electrostatic latent image, the developing device holder 4 is activated to move the yellow developing device 4Y to a developing position opposed to the photosensitive drum 1, and a voltage of a polarity same as the charging polarity of the photosensitive drum 1 and of a potential substantially same as the potential thereof so as to deposit a yellow toner onto the electrostatic latent image on the photosensitive member 1 thereby developing the electrostatic latent image. Thereafter a voltage of a polarity opposite to that of the toner is applied to the primary transfer roller 5*j*, thereby executing a primary transfer of the yellow toner image of the photosensitive drum 1 onto the intermediate transfer belt 5*a*.

After the primary transfer of the yellow toner image as explained in the foregoing, a developing device of a next color is moved to the developing position opposed to the photosensitive drum 1, and a formation of an electrostatic latent image, a development and a primary transfer to the intermediate transfer belt 5*a* are executed, in a similar manner as in the yellow toner, for magenta (M), cyan (C) and black (Bk) colors in succession, whereby toner images of four colors are formed in superposition on the intermediate transfer belt 5*a*.

During these operations, the secondary transfer roller 11 is maintained in a non-contact state separated from the intermediate transfer belt 5*a*. Also the charging roller 5*f* serving as the cleaning unit is maintained in a non-contact state separated from the intermediate transfer belt 5*a*.

On the other hand, the feeding roller 18 of the sheet feeding portion is activated to separate and convey one of the recording materials stacked in the sheet cassette 19, toward the paired registration rollers 7*d*. Immediately behind the paired registration rollers 7*d*, a registration sensor 14 is provided for detecting a leading end of the recording material and interrupting the rotation of the registration rollers 7*d* thereby causing the recording material to wait in a predetermined position. Thus the recording material is held in a temporary waiting state in a position in the vicinity of the paired registration rollers 7*d*.

After the toner images of four colors are formed on the intermediate transfer belt 5*a*, the secondary transfer roller 11 is press contacted with the intermediate transfer belt 5*a* (state shown in FIG. 1), and the paired registration rollers 7*d* are re-activated to advance the recording material, in a waiting state in the predetermined position in the vicinity of the paired registration rollers 7*d*, to the secondary transfer portion formed by a nip of the intermediate transfer belt 5*a* and the secondary transfer roller 11, in synchronization with the rotation of the intermediate transfer belt 5*a*. The recording material is re-fed by the paired registration rollers 7*d* at such a timing that a leading end of the four-color toner images formed on the intermediate transfer belt 5*a* reaches the secondary transfer portion when a leading end of the recording material reaches the secondary transfer portion. Also the secondary transfer roller 11 is given a voltage of a polarity opposite to that of the toner, whereby the four-color toner images on the intermediate transfer belt 5*a* are subjected to a collective secondary transfer onto the surface of the recording material in the secondary transfer portion.

The recording material thus subjected to the secondary transfer is conveyed through the conveyor belt unit 12 to the fixing apparatus 8, then subjected to a fixation of toner images of plural colors (color mixing by fusing), then conveyed by the paired conveying rollers 13 along the discharge guide 15 and discharged by the paired discharge rollers 9 onto a face-down discharge tray 10 provided in an upper part of the image forming apparatus A, whereby the image formation process is completed.

On the other hand, after the secondary transfer of the toner image from the intermediate transfer belt 5*a* to the recording material in the secondary transfer portion, the charging roller 5*f* serving as the belt cleaning unit is pressed to the intermediate transfer belt 5*a* to provide the toner remaining on the intermediate transfer belt 5*a* with a charge of a polarity opposite to that at the charging. The residual toner with the charge of the opposite polarity is attracted electrostatically to the photosensitive drum 1, and is thereafter recovered by the drum cleaning unit 6 for the photosensitive drum 1. The recovered residual toner is recovered and accumulated as a used toner in a used toner box 16.

(2) Fixing Apparatus (Image Heating Apparatus) 8

Figure 2:
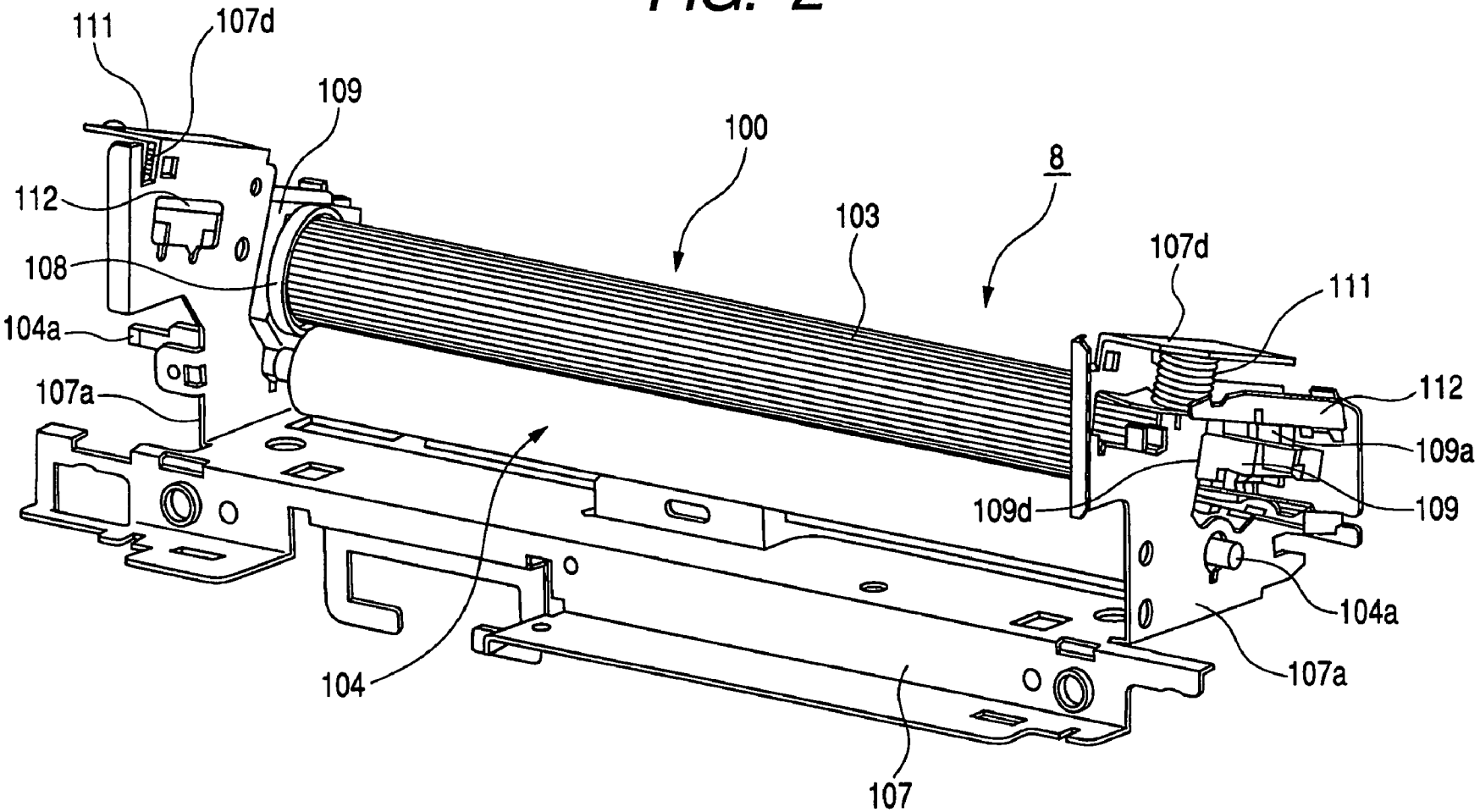
FIG. 2 is a perspective view of a fixing apparatus.
Figure 3:
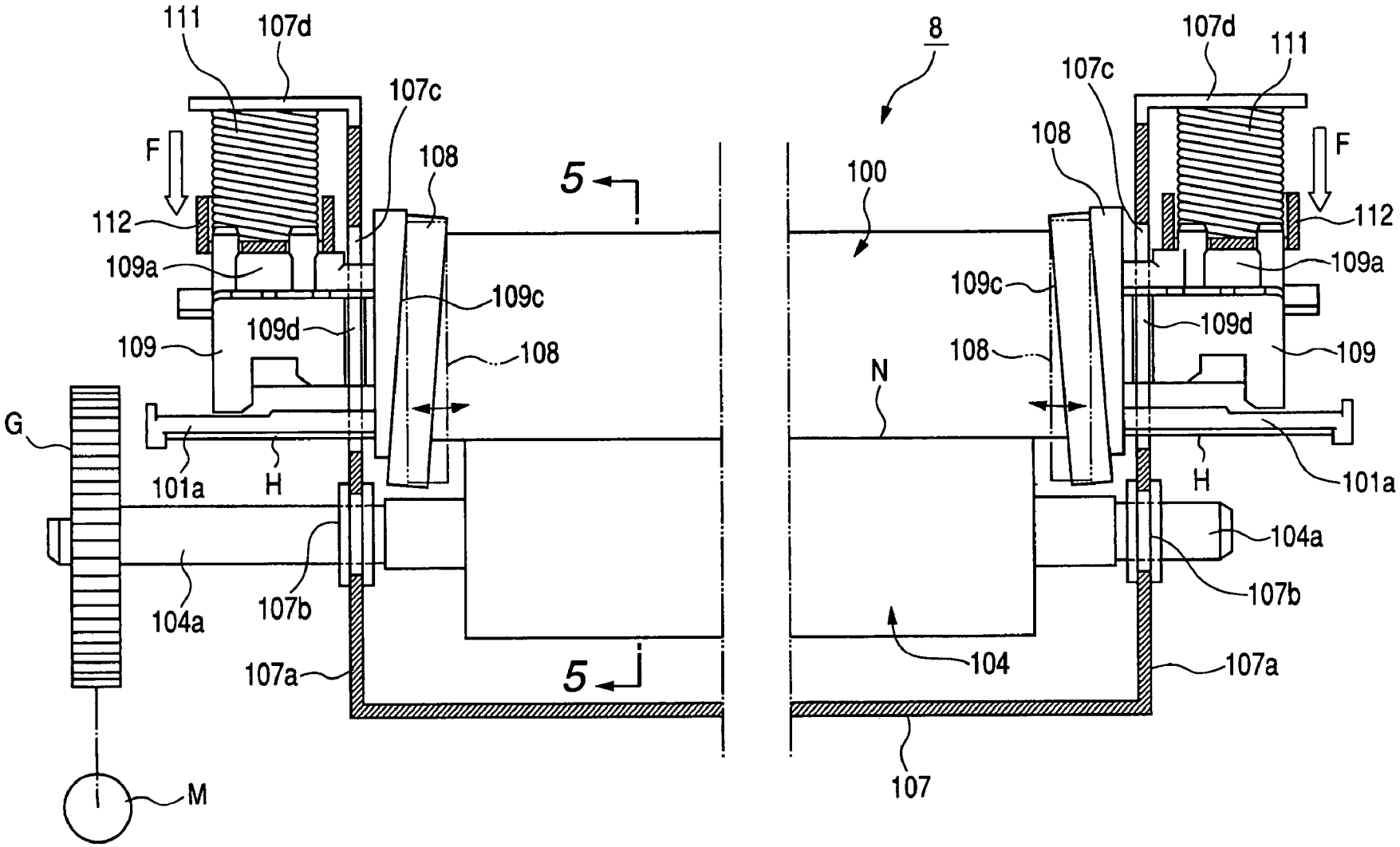
FIG. 3 is an elevation view of the fixing apparatus with an interim portion being cut off.
Figure 4:
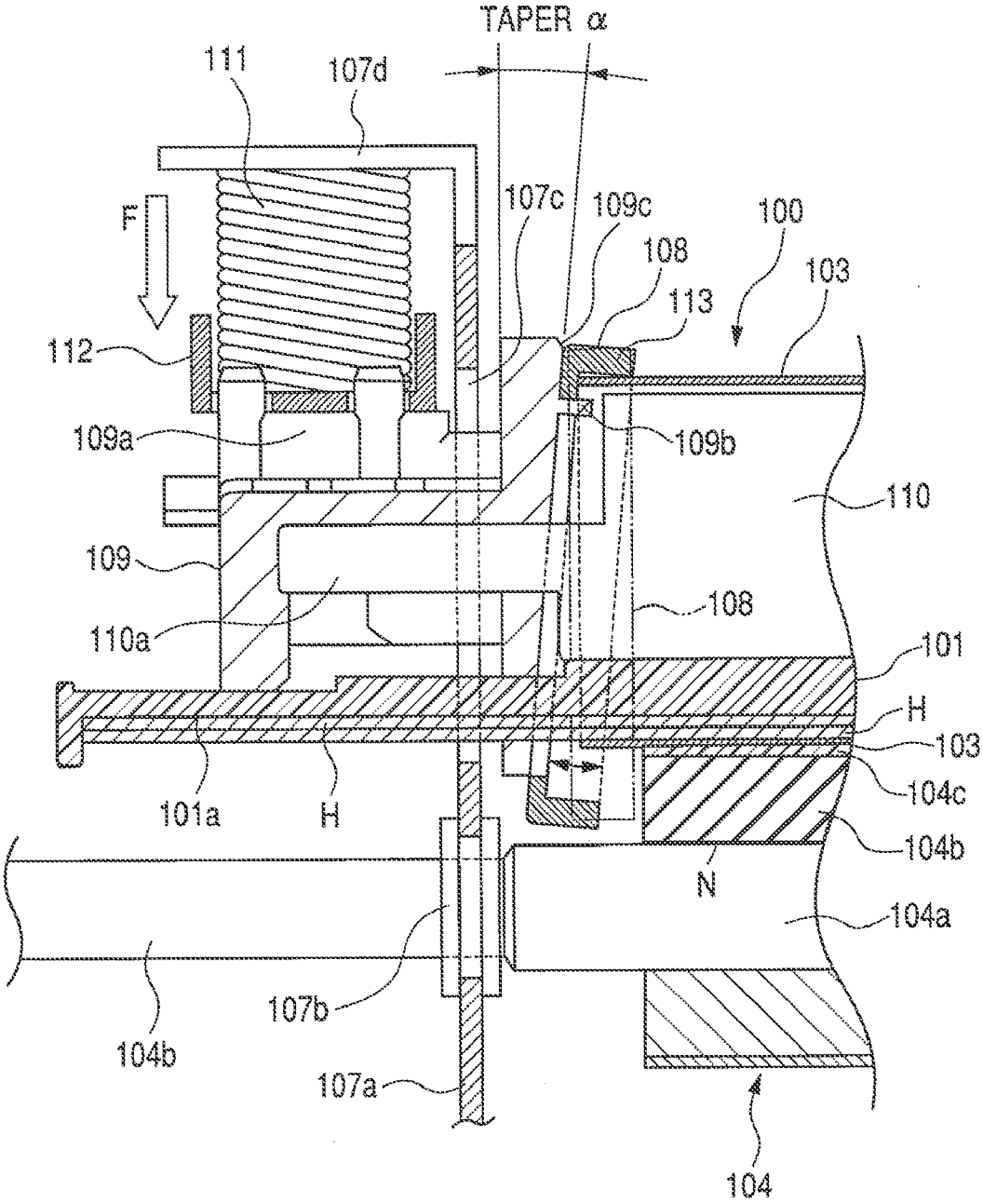
FIG. 4 is a magnified longitudinal cross-sectional view of an end portion of the fixing apparatus.
Figure 5:
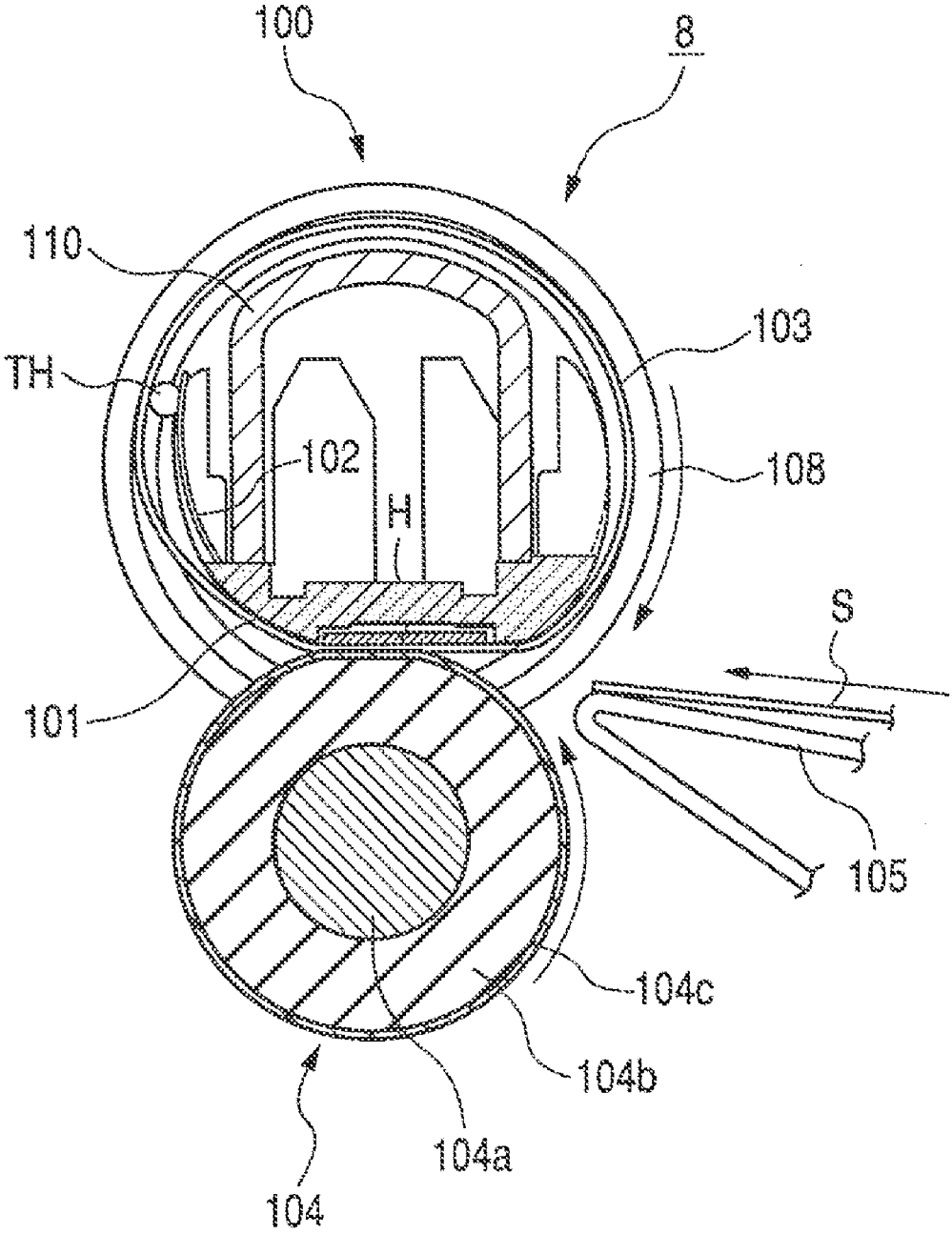
FIG. 5 is a transversal cross-sectional view along a line 5-5 in FIG. 3.
Figure 6:
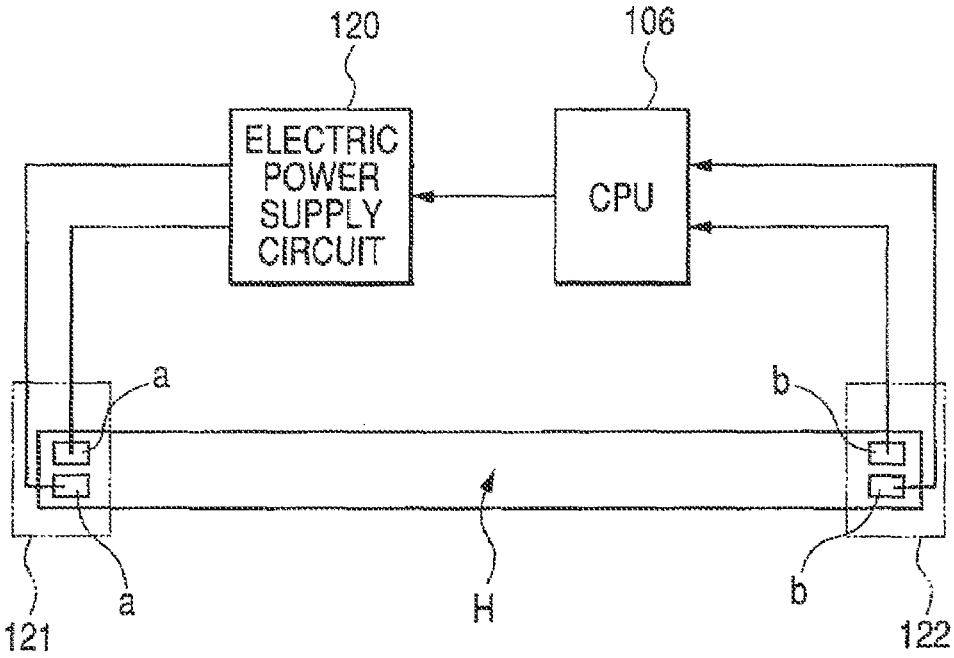
FIG. 6 is a block diagram of a power supply system to a heater.

FIG. 2 is a perspective view of the fixing apparatus 8; FIG. 3 is an elevation view of the fixing apparatus with an interim portion being cut off; FIG. 4 is a magnified longitudinal cross-sectional view of an end portion of the fixing apparatus; and FIG. 5 is a transversal cross-sectional view along a line 5-5 in FIG. 3.

A heating assembly 100 and a pressure roller 104 constituting a pressurizing member are mutually contacted to form a nip portion (fixing nip portion) N for nipping and conveying the recording material thereby heating an image thereon.

The heating assembly 100 is an assembly of:

a: a heater holder 101 formed with a heat-resistant liquid crystal polymer resin;

b: a thin and oblong ceramic heater (slidable member) H serving as heating means provided on a lower face of the heater holder 101 along the longitudinal direction thereof;

c: a fixing stay 110 of a downward U-shaped cross section provided inside the heater holder 101;

d: a fixing belt 103 constituting a flexible sleeve-shaped rotary member loosely fitted externally on an assembly of the heater holder 101, the heater H and the fixing stay 110;

e: a fixing flange 108 provided on each edge portion of the fixing belt 103 and serving as a fixing belt supporting member for rotationally supporting the edge portion of the fixing belt 103 in a radial direction from a side of an external peripheral surface thereof and in a thrust direction from a lateral side (edge side), and an edge holder 109 constituting a restricting member provided with a boss portion 109*b* for rotationally supporting an internal peripheral surface of the fixing flange 108, and fixing belt edge restricting face 109*c* for restricting an edge portion of the fixing belt 103 in the thrust direction across the fixing flange 108; and f: a thermistor TH constituting a temperature detecting element supported on a front end portion of an elastic stainless steel arm 102 (FIG. 5) fixed at a base portion thereof to the heater holder 101 and elastically contacted with the internal surface of the fixing belt 103.

The fixing flange 108 is mounted rotatably with respect to the edge holder 109. Also an edge face of the fixing belt 103, when moved in the thrust direction, contacts the fixing flange 108 which impinges on the sleeve restricting face 109*c* of the edge holder 109, so that the edge holder 109 constitutes a restricting member for restricting the movement of the fixing belt (flexible sleeve) 103 in the generatrix direction of the fixing belt 103.

The pressure roller (driving roller) 104 is formed, on a stainless steel metal core 104*a*, by injection molding a silicone rubber layer 104*b* of a thickness of about 3.5 mm and coating thereon a PFA resin tube (releasing layer) 104*c* of a thickness of about 40 μm. The pressure roller 104 is rotatably supported, on both ends of the metal core 104*a*, by bearing members 107*b* between front and rear lateral plates 107*a* of a frame 107 of the apparatus. A driving gear G is fixed on an end portion of the metal core 104*a*. A driving power is transmitted from a drive system M to the driving gear G for rotating the pressure roller 104 counterclockwise as indicated by an arrow in FIG. 5.

Figure 8:
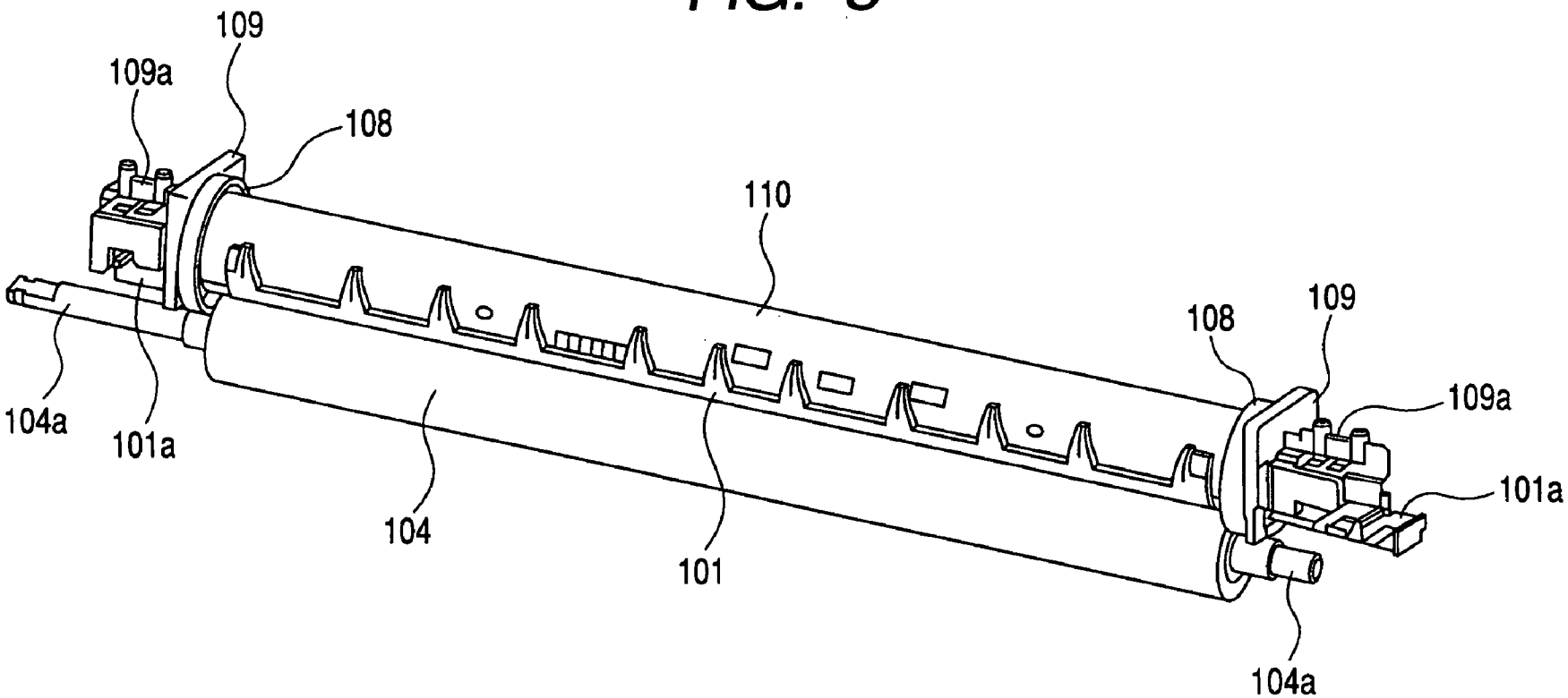
FIG. 8 is an external perspective view of a heating assembly and a pressure roller, with a fixing belt removed.

The heating assembly 100 is provided, with the side of the heater H downwards, above and parallel to the pressure roller 104. End holders 109 on both end portions protrude to the exterior from vertical slits 107*c* formed on the front and rear lateral plates 107*a* of the frame 107, and are rendered vertically slidable along the vertical edges of the vertical slits 107*c* on which vertical guide groove portions 109*d* are fitted. Also the end holders 109 on both end portions are respectively fitted on extension arms 110*a* externally protruding on both end portions of the fixing stay 110 as shown in FIGS. 4 and 8.

An upper pressing portion 109*a* on each end holder 109 receives a downward pressure F by a pressure plate (pressurizing lever) 112 whereby the fixing stay 110 presses down the heating assembly 100 toward the pressure roller 104 against the elasticity of the silicone rubber layer 104*b* thereof. Thus the heater H is pressed to the pressure roller 104 across the fixing belt 103 thereby forming a fixing nip portion (pressurized nip portion) N of a predetermined width between the heating assembly 100 and the pressure roller 104.

The fixing belt 103 has a total length, in the generatrix direction, larger than a length of contact face of the pressure roller 104 (longitudinal length of the fixing nip portion N).

The pressure plates 112 are respectively provided outside the front and rear lateral plates 107*a* of the frame 107, with an end articulated rotatably, while an interim portion of the pressure plate is contact at a lower face thereof with an upper face pressing portion 109*a* of the edge holder 109, and a compression spring 111 is positioned between an upper face of a free end of the pressure plate and a fixed folded portion 107*d* of the lateral plate 107*a* to apply a pressure F on the upper pressing portion 109*a* of each edge holder 109. In the present embodiment, the heating assembly 100 is pressed toward the pressure roller 104 with a total pressure of 20 kgf (10 kgf on each side).

The aforementioned pressurizing mechanisms 111, 112 have an unillustrated releasing mechanism which releases the pressure for facilitating elimination of the recording material for example in case of a jam processing.

The heater holder 101 is provided, on both ends thereof, with extension arms 101*a* externally protruding from vertical slits 107*c* formed on the front and rear lateral plates 107*a* of the frame 107. The heater H is extended at both end portions thereof to the extension arms 101*a*, and is provided with a power supply contact a at an end and with a temperature controlling contact b at the other end. A power supply connector 121 is fitted on an extension arm 101*a* of the heater holder 101 whereby an electrical contact of the connector 121 contacts the power supply contact a of the heater H to form an electrically communicating state between the heater H and a power supply circuit 120 of the main body of the image forming apparatus. Also a temperature regulating connector 122 is fitted on the other extension arm 101*a* of the heater holder 101. Thus an electrical contact of the temperature regulating connector 122 contacts the temperature regulating contact b of the heater H whereby an electrical temperature information of the thermistor TH (FIG. 5) can be entered through the temperature regulating contact b and the temperature regulating connector 122 to a control circuit (CPU) 106 of the main body of the image forming apparatus.

In the fixing apparatus 8 of the present embodiment, the rotation of the pressure roller 104 causes the fixing belt 103 to be rotated clockwise, as indicated by an arrow in FIG. 5, around the heater holder 101 and the fixing stay 110 by the frictional force at the fixing nip portion N. In this state, the internal surface of the fixing belt 103 slides on the heater 100 and the heater holder 101. Grease is coated on the sliding surface of the heater 100 and is spread over the entire internal surface of the fixing belt 103 by the rotary motion thereof, thereby securing slidability of the internal surface of the fixing belt 103 over the heater 100 and the heater holder 101.

In the normal use, simultaneous with the start of rotation of the fixing apparatus (rotation of the pressure roller 104 and resulting rotation of the fixing belt 103), a power supply is started from the power supply circuit 120 to the heater H. The heater H shows a rapid temperature increase to heat the rotating fixing belt 103. The temperature increase in the fixing belt 103 is detected by the thermistor TH contacting the internal surface of the fixing belt 103, and electrical temperature information is supplied to the control circuit 106. The control circuit 106 controls the power supply from the power supply circuit 120 to the heater H in such a manner that the temperature information of the fixing belt 103 entered from the thermistor TH is maintained at a predetermined fixing temperature, whereby the heater H or the fixing belt 103 is controlled at a predetermined temperature. In the thermistor TH, a thermistor element is mounted on a front end of the stainless steel arm 102 and is maintained in constant contact with the internal surface of the fixing belt 103 by a rocking motion of the arm 102 even when the internal surface of the fixing film 103 shows an unstable movement.

Then, in a state of the fixing apparatus where the rotation therein is started and the heater H is powered to control the fixing belt 103 at the predetermined fixing temperature, a recording material S to be subjected to an image fixation is guided by an entrance guide 105 and introduced into the fixing nip portion N. The entrance guide 105 is fixed on the frame 107 of the apparatus and serves to guide the recording material, after passing the secondary transfer nip, exactly to the fixing nip portion N.

The recording material S introduced into the fixing nip portion N is nipped and conveyed therein, and is heated by the heat of the fixing belt 103 and pressed by the pressure of the fixing nip portion N in the course of such nipping and conveying, whereby the four-color toner images on the recording material S are fixed (color mixing by fusing) as a permanent fixed image on the recording material S. After emerging from the fixing nip portion N, the recording material S is separated by a curvature from the surface of the fixing belt 103, then conveyed by the paired conveying rollers 13 along the discharge guide 15, and discharged by the paired discharge rollers 9 onto the face-down discharge tray 10 in the upper part of the image forming apparatus A, whereby the image formation is completed.

(3) Fixing Belt (Flexible Sleeve) 103

Figure 7:
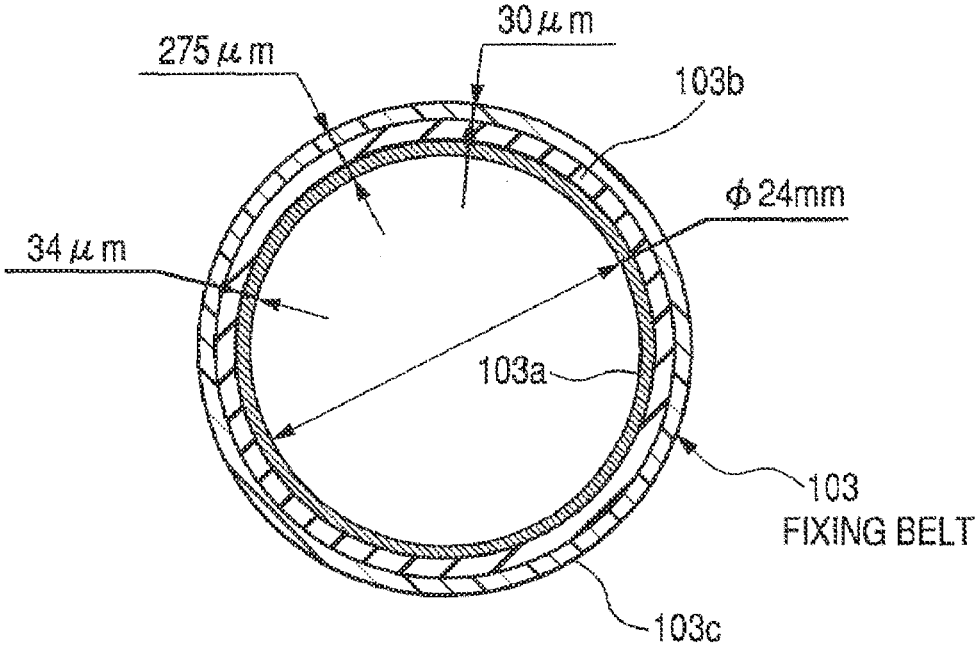
FIG. 7 is a schematic cross-sectional view showing a layer configuration of a fixing belt.

The fixing belt 103 is constituted by forming an elastic layer and a releasing layer on a metal substrate layer. FIG. 7 is a schematic cross-sectional view showing a layered structured of the fixing belt 103 employed in the present embodiment.

The fixing belt 103 is formed, on a SUS belt (substrate layer) 103*a* prepared by drawing a SUS element tube into a seamless belt of a thickness of 34 μm, by coating a silicone rubber layer (elastic layer) 103*b* by a ring coating method, and providing thereon a PFA resin tube of a thickness of 30 μm as a releasing layer 103*c*. For the purpose of temperature elevation, it is preferable to employ a material of a thermal conductivity as high as possible in the silicone rubber layer 103*b* thereby reducing the heat capacity of the fixing belt 103. The present embodiment employs silicone rubber of a relatively high thermal conductivity of about $1.0\times10^{-3}$ cal/sec·cm·K.

On the other hand, in consideration of the transparency in an OHP sheet and the image-quality such as small gloss unevenness, the silicone rubber layer 103*b* of the fixing belt 103 is preferably as thick as possible. Investigation of the present inventors has clarified that a thickness of the rubber layer of 200 μm or larger is necessary for obtaining an image quality of a satisfactory level.

In the present embodiment, the silicone rubber layer had a thickness of 275 μm, and the fixing belt 103 had an internal diameter of 24 mm.

Also a fluorinated resin layer provided on the surface of the fixing belt 103 allows to improve the releasing property of the surface, thereby preventing an offset phenomenon which is generated by toner once attracted on the surface of the fixing belt 103 and again transferred to the recording material S.

(4) Fixing Flange (Ring-Shaped Member) 108 and Edge Holder (Restricting Member) 109

Figure 9:
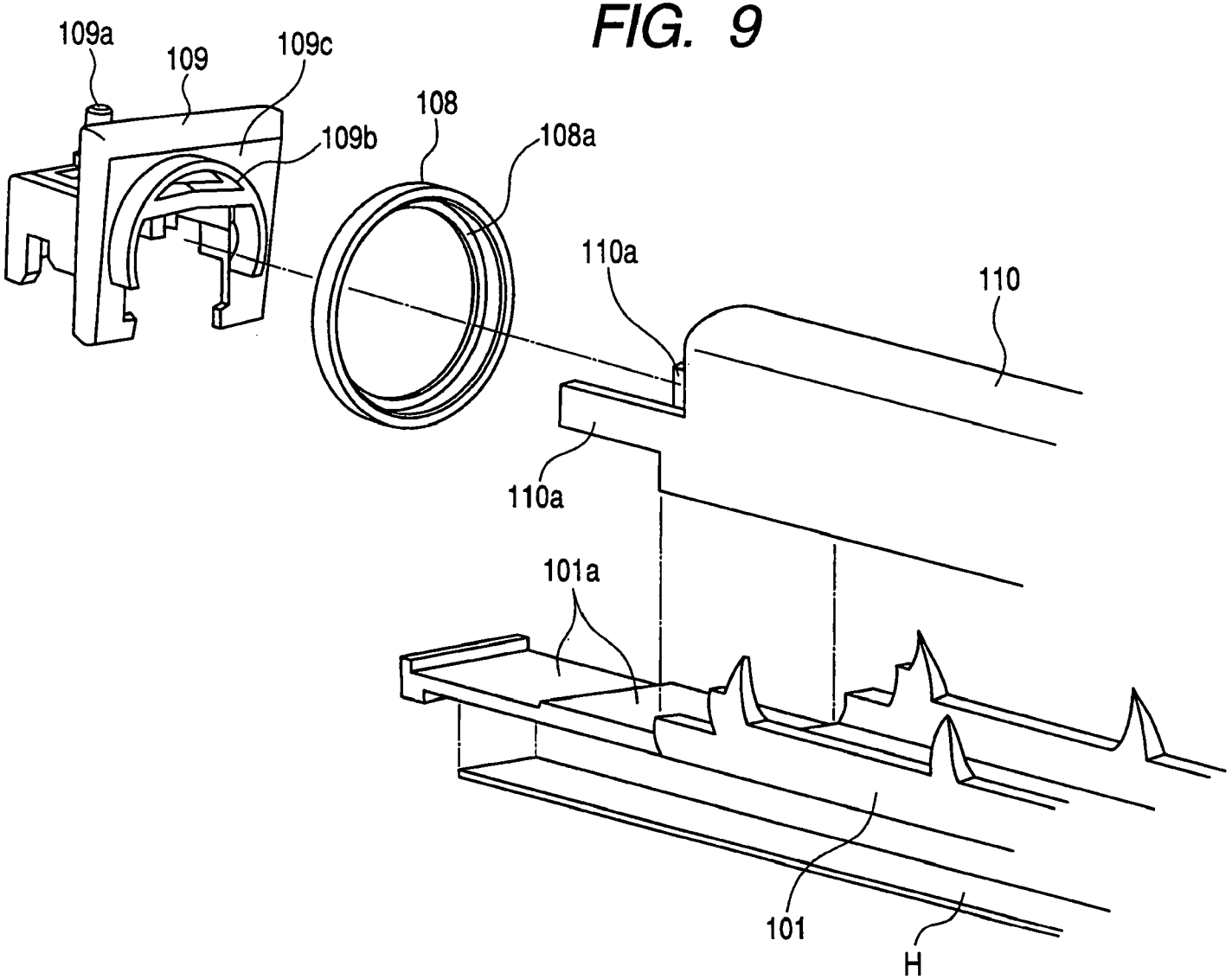
FIG. 9 is an exploded perspective view of an end side of the heating assembly, with a fixing belt removed.
Figure 10:
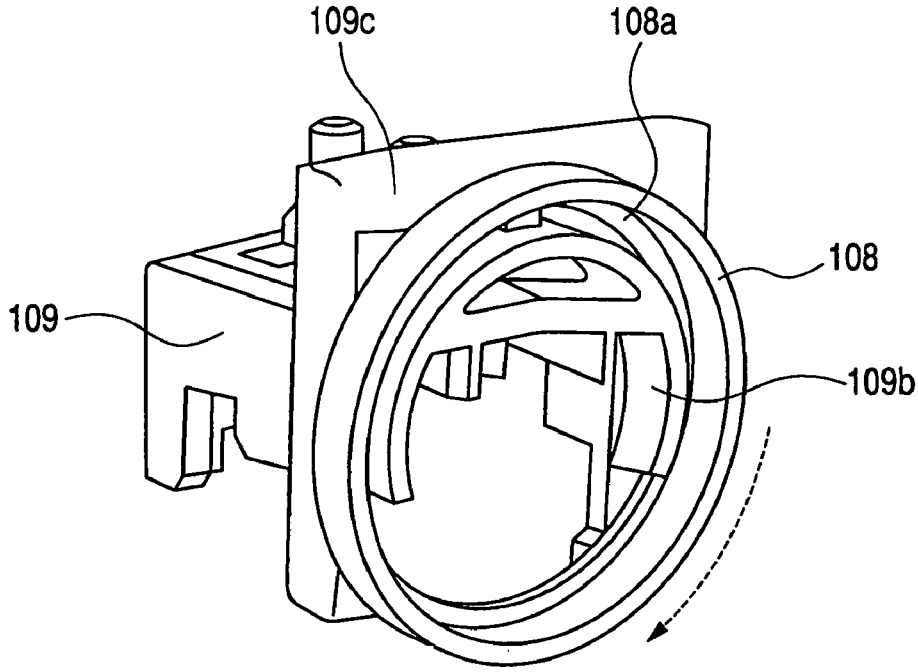
FIG. 10 is a perspective view of a fixing flange and an edge holder in an end side.

FIG. 8 is an external perspective view of a heating assembly and a pressure roller, with a fixing belt removed; FIG. 9 is an exploded perspective view of an end side of the heating assembly, with a fixing belt removed; FIG. 10 is a perspective view of a fixing flange and an edge holder in an end side; and FIG. 11 is a view of an internal side of the fixing flange and the edge holder.

The fixing flange 108 is a short-cylindrical annular member serving as a fixing belt supporting member for rotationally supporting the edge portion of the fixing belt 103 from a side of external peripheral surface in the radial direction and from a lateral side (edge face) in the thrust direction.

The edge holder 109 rotationally supports an internal peripheral face of the fixing flange 108 by the boss portion 109*b*, and restrict a motion of the fixing flange 108 in the thrust direction. Thus the edge holder 109 functions as a restricting member provided with the boss portion 109*b* which rotationally supports the internal peripheral face of the fixing flange 108, and the fixing belt edge restricting face 109*c* which restrict the edge portion of the fixing belt 103 in the thrust direction.

Figure 11:
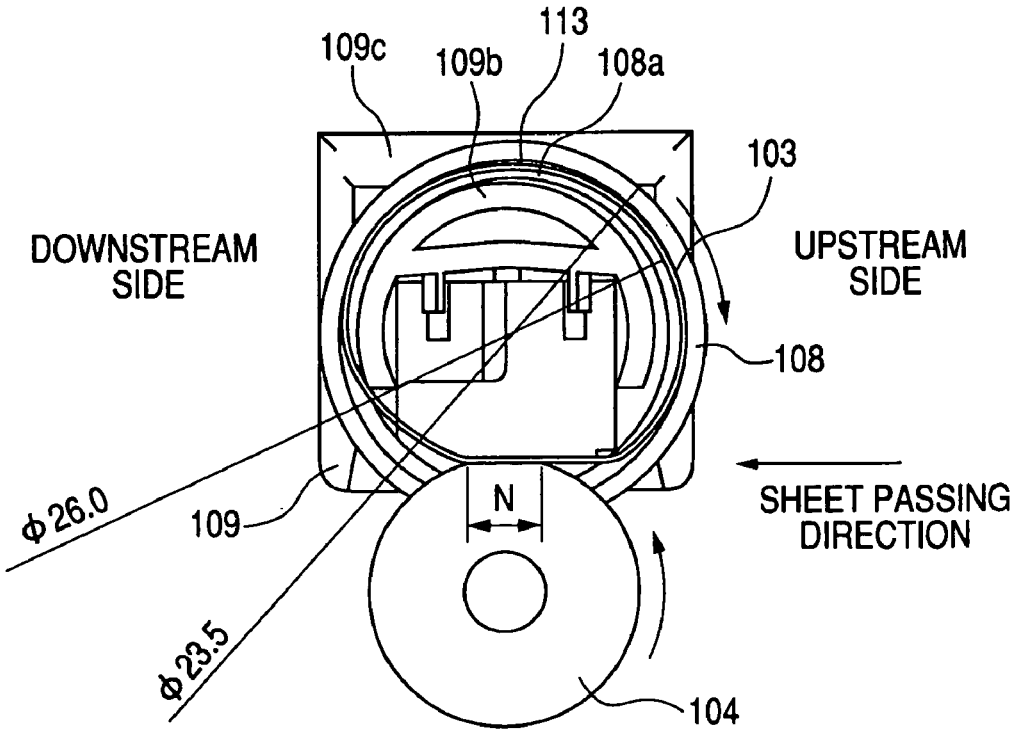
FIG. 11 is a view of an internal side of the fixing flange and the edge holder.

As shown in FIG. 11, the fixing flange 108 has an internal diameter ϕ26 larger than the external diameter of the fixing belt 103, and the fixing belt 103 deformed by the pressure roller 104 contact the internal surface of the fixing flange 108 to generate a frictional force, whereby the fixing belt 103 and the fixing flange 108 rotate together thereby preventing a frictional contact on the edge portion of the fixing belt 103.

Figure 12:
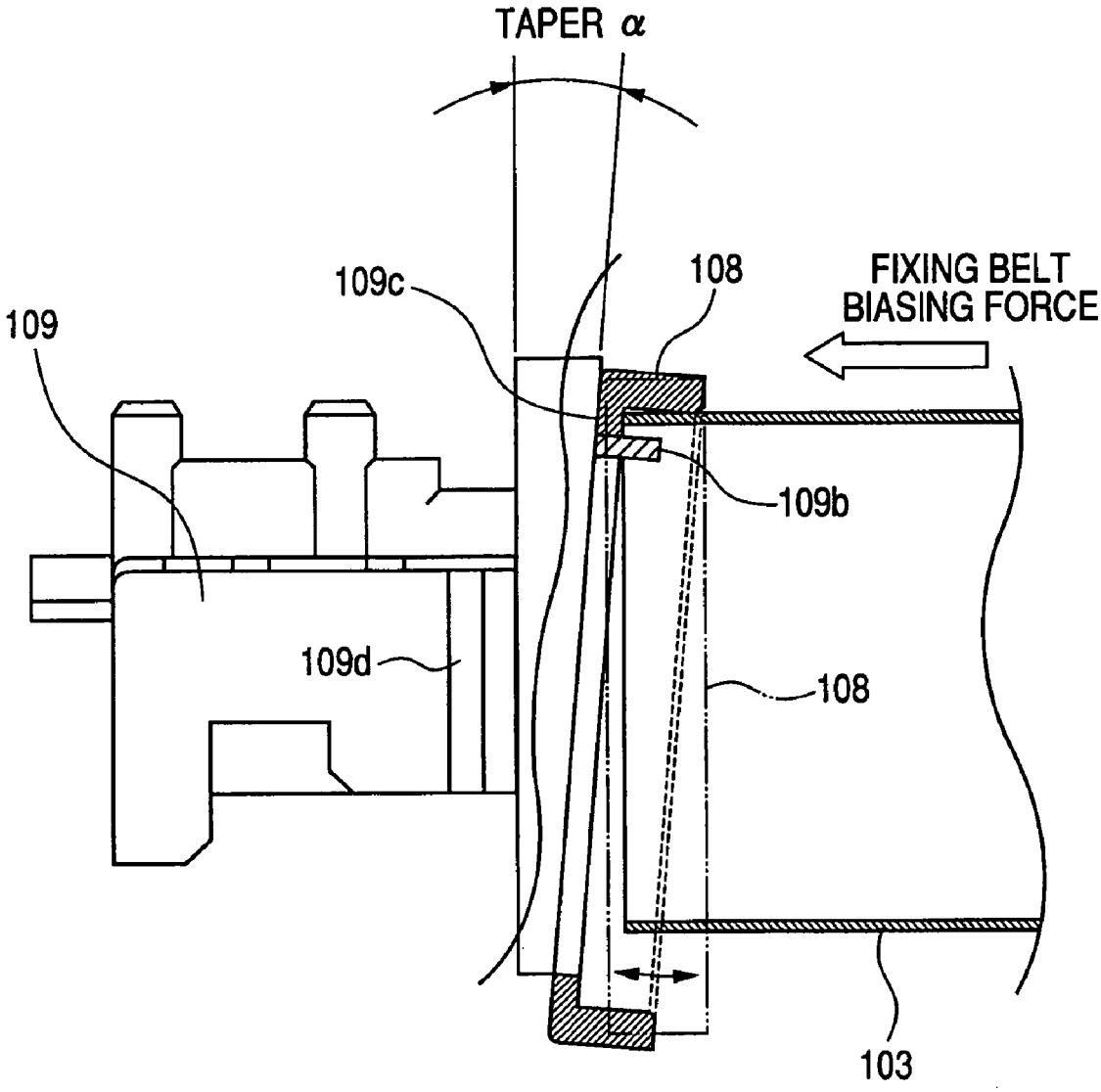
FIG. 12 is a view showing a restriction state for the fixing belt.

Also in the present embodiment, a frictional face (fixing belt edge restricting face, or sleeve restricting face) 109*c* of the edge holder 109 in frictional contact with the fixing flange 108 is tapered by an angle a in such a manner that, as shown in FIGS. 4 and 12, a portion farther from the fixing nip portion N is closer to the fixing belt 103 and a portion close to the fixing nip portion N is farther from the fixing belt 103.

Also the frictional face 109*c* of the edge holder 109 and the fixing flange 108 are so constructed as to be in contact outside the external periphery of the fixing belt 103, so that, when the fixing belt 103 is moved in the longitudinal direction, the fixing flange 108 is pushed by the fixing belt 103 and becomes positioned along the frictional face 109*c* of the edge holder 109 as shown in FIG. 12.

More specifically, when the peripheral length of the fixing belt is approximately equally bisected into two areas by a line parallel to the nip line of the fixing nip portion N, the frictional face 109*c* of the edge holder 109 and the fixing flange 108 are not in mutual contact in an area closer to the fixing nip portion N but in mutual contact in an area farther from the fixing nip portion N and only in the outside of the external periphery of the fixing belt 103, and, when the fixing belt 103 is moved in the thrust direction, the fixing flange 108 is inclined by the fixing belt 103 from a chain-lined position to a solid-lined position whereby the edge portion of the fixing belt 103 is restricted in the thrust direction, only in a side opposite to the fixing nip portion N. Thus, within an edge face of the sleeve in a mounted state on the apparatus, equally bisected by an imaginary plane substantially parallel to a nip plane of the nip portion into a first area closer to the nip portion and a second area farther from the nip portion, the edge holder 109 executes a restricting action on the second area only (more exactly on a part of the second area).

Figure 13:
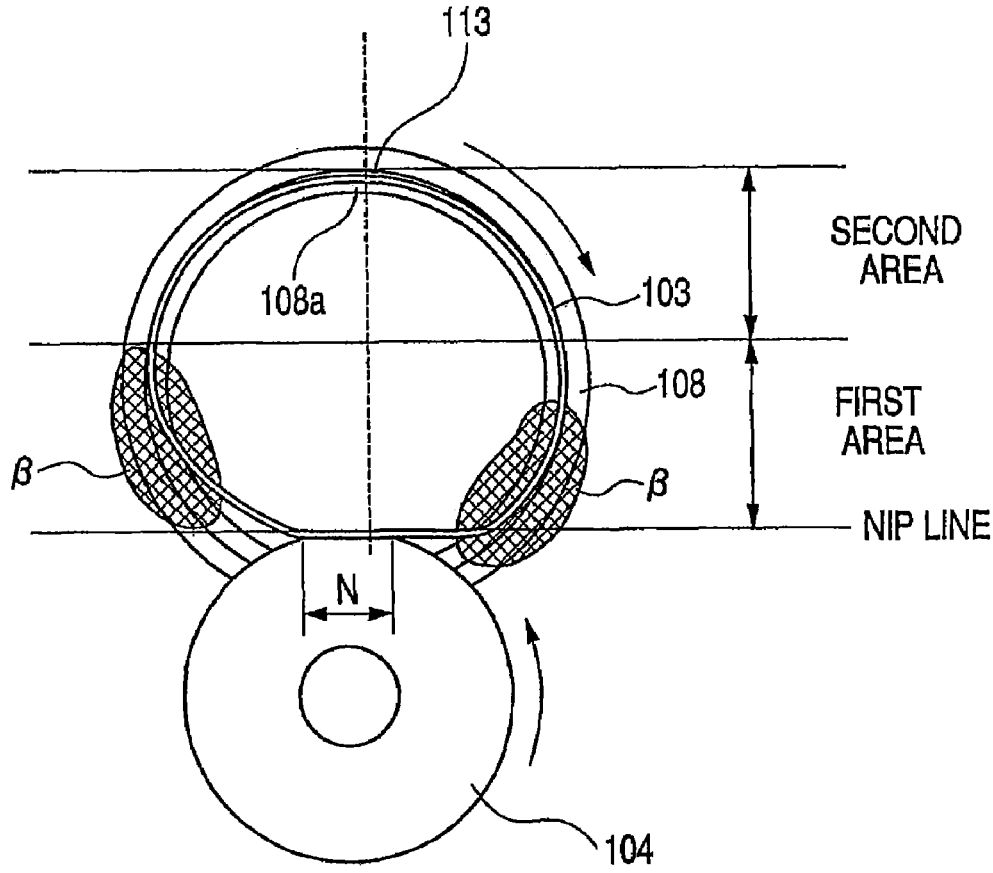
FIG. 13 is a view showing contact positions between the fixing belt and the fixing flange;.
Figure 20:
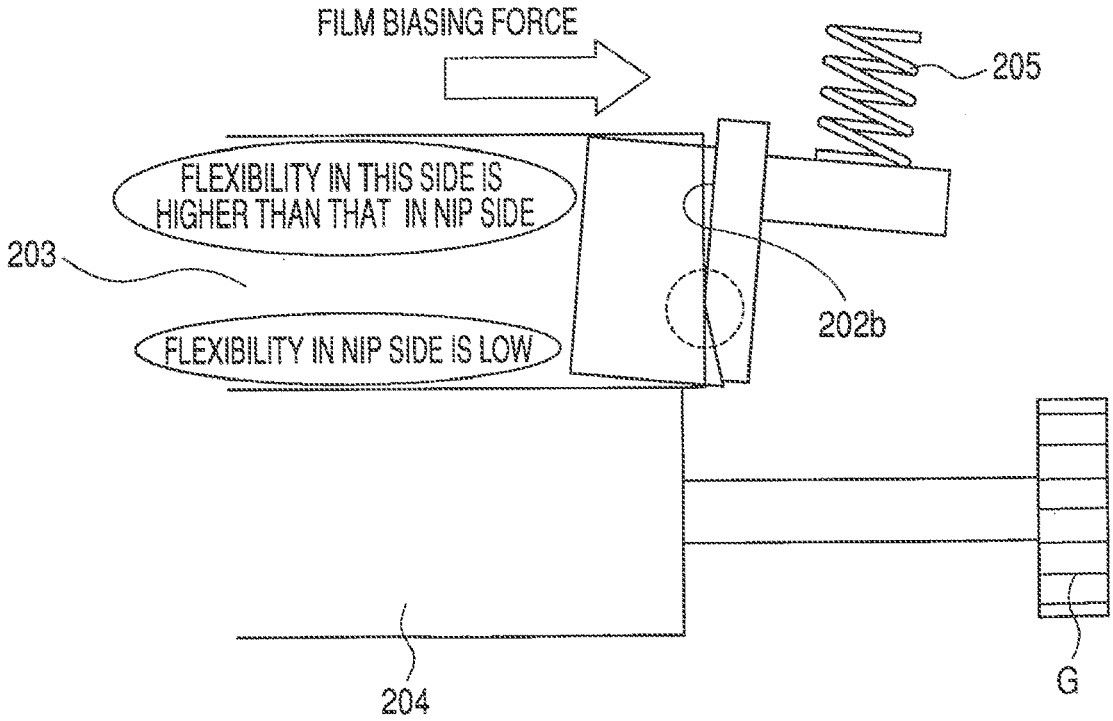
FIG. 20 PRIOR ART
FIG. 20 is a schematic view showing a film movement in case a flange is inclined outwards.
Figure 21:
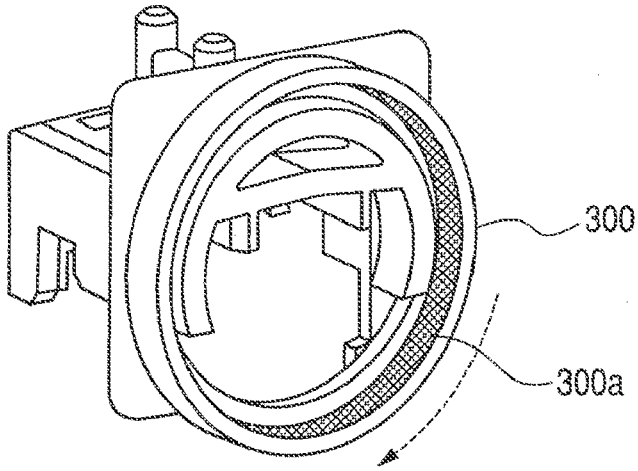
FIG. 21 PRIOR ART
FIG. 21 is a perspective view showing a fixing flange in a prior configuration.
Figure 22:
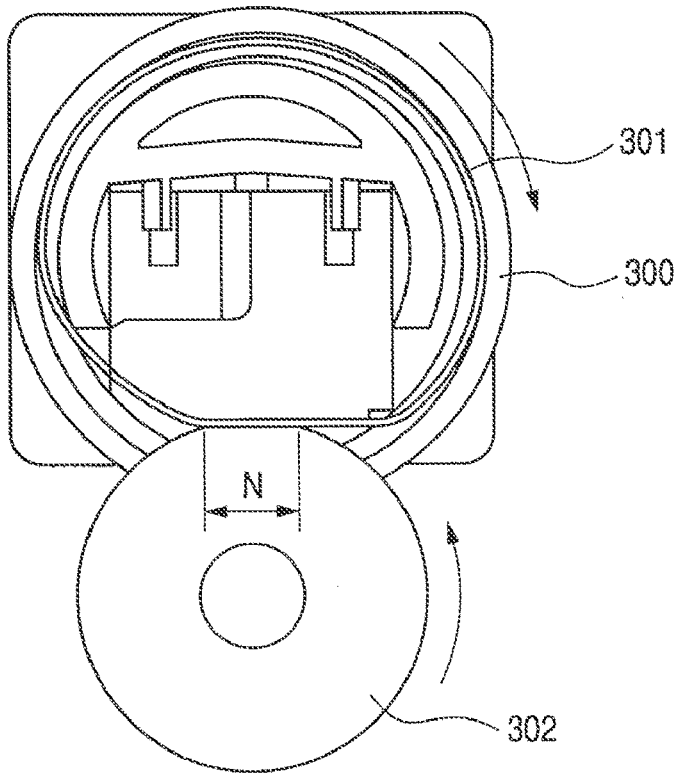
FIG. 22 PRIOR ART
FIG. 22 is a cross-sectional view showing a fixing flange in a prior configuration.
Figure 23:
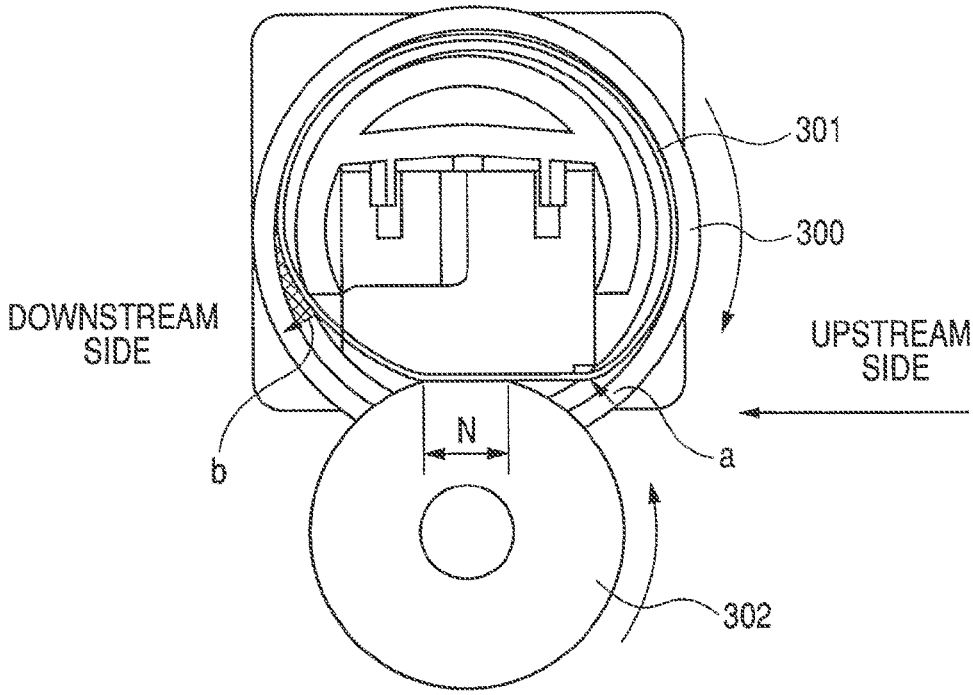
FIG. 23 PRIOR ART
FIG. 23 is a view showing a frictional contact state of the fixing belt and the fixing flange in a prior configuration.
Figure 24:
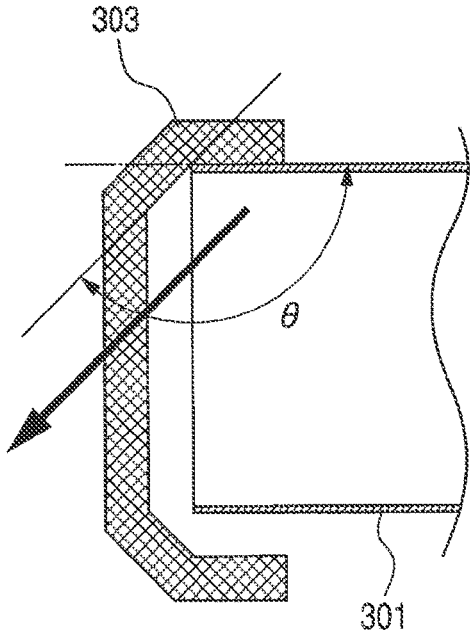
FIG. 24 PRIOR ART
FIG. 24 is a view showing a restriction state for the fixing belt in a prior configuration.

As a result, the fixing flange 108 is in contact with the fixing belt 103 only in a portion (contact point 113) which is separated from the fixing nip portion N and has flexibility, so that, even when the edge of the fixing belt impinges on the restricting face 108*a* by a biasing force, a strong stress is not applied to the edge portion of the fixing belt. Also even in case the edge holder 109 is mounted in an inclined position as in the flange 202 shown in FIG. 20 for example by tolerance in the components, a frictional force is exerted on the fixing belt 103 in an area thereof deformed by the nip formation (hatched area B in FIG. 13), so that a defect such as a small crack present on the edge of the fixing belt is not enlarged and the service life of the belt can be elongated.

Also within the fixing belt edge restricting face 109*c* of the edge holder 109, a portion restricting the second area is at least provided outside the external periphery of the fixing belt, and a gap between the fixing belt edge restricting face 109*c* of the edge holder 109 and the edge of the fixing belt 103 in the thrust direction is made gradually larger from the second area toward the first area. Stated differently, an inclined positioning of the fixing belt edge restricting face 109*c* of the edge holder 109 so as to become gradually farther from the second area of the belt edge toward the first area enables to form the contact portion of the edge portion of the fixing belt and the fixing flange 108 only in a farther side (second area) with respect to the fixing nip portion N. Thus, since the fixing belt 103 in a state mounted on the apparatus is restricted only in a highly flexible portion thereof, the edge portion of the fixing belt does not locally impinge on the restricting face in the vicinity of the fixing nip portion N even in case the restricting member is inclined for example by tolerance in the assembling. Also the fixing belt 103, not in contact with the fixing flange 108 in an area close to the fixing nip where it is deformed by the pressure roller 104, does not receive a frictional contact in the radial direction. Therefore a margin can be secured against a breakage in the edge portion of the fixing belt.

The fixing flange 108 and the edge holder 109 at the other end of the heating assembly 100 have same structure and function as explained above. In case the fixing belt 103 is so constructed as to displace always toward a side in the longitudinal direction, the aforementioned fixing flange 108 may be provided only in the moving side of the fixing belt 103 and may be dispensed with at the other end.

Embodiment 2

(1) Example of Image Forming Apparatus

Figure 14:
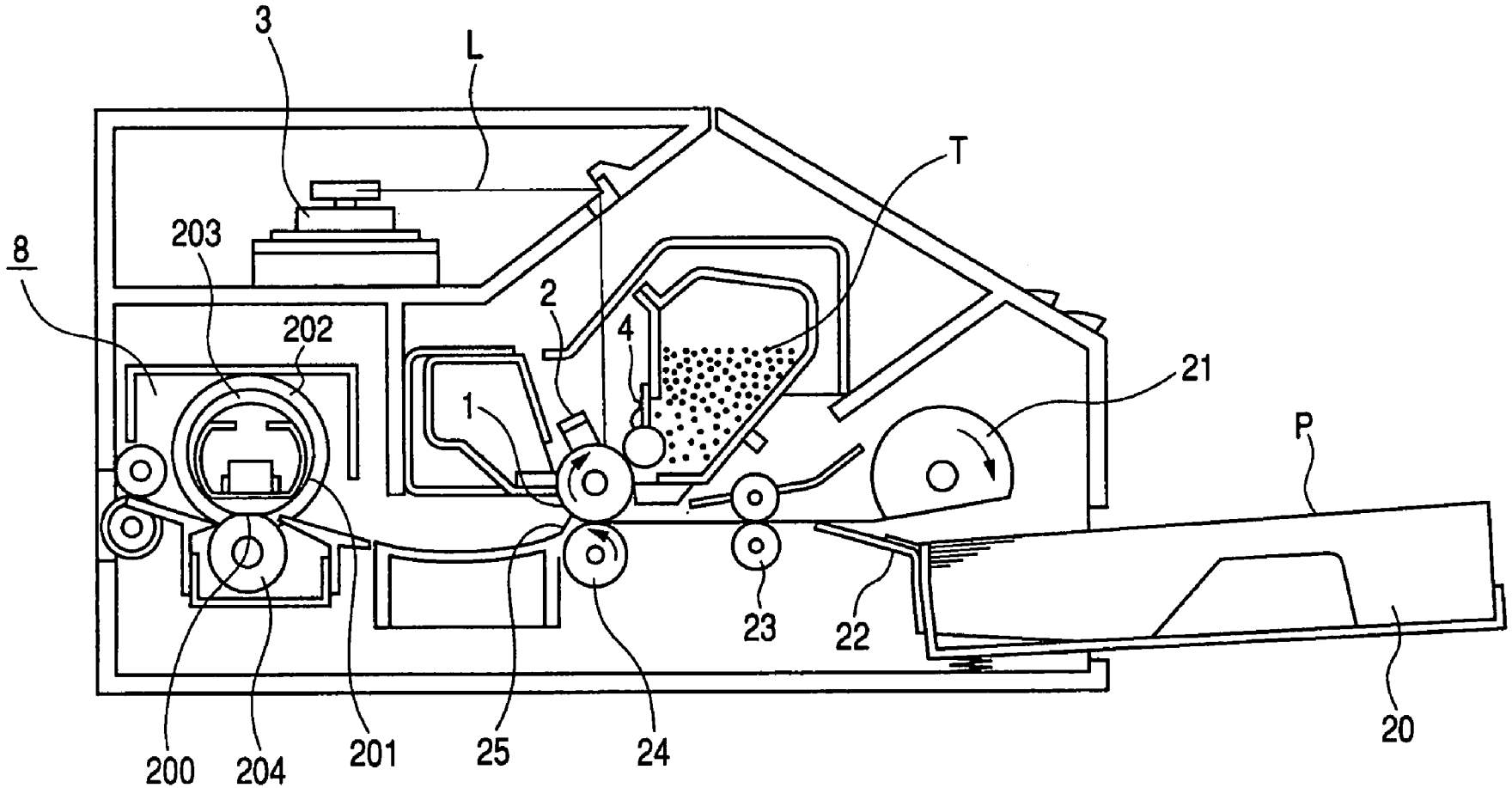
FIG. 14 is a schematic view showing a configuration of an image forming apparatus in an embodiment 2.

FIG. 14 is a schematic view showing a configuration of an image forming apparatus employing an image heating apparatus, constituting a second embodiment of the present invention, as a fixing apparatus. The image forming apparatus of the present embodiment is a monochromatic laser beam printer utilizing an electrophotographic process.

An electrophotographic photosensitive member (hereinafter written as drum) 1 is rotated at a predetermined peripheral speed. In the course of rotation, the drum 1 is uniformly charged to a predetermined positive or negative potential by a primary charger 2, and is then subjected to a writing of desired image information by a scanning laser beam L from a laser scanner 3. Thus an electrostatic latent image is formed on the drum 1. The latent image borne on the surface of the drum 1 receives a supply of a toner T by a developing apparatus 4 to form a visible toner image.

Transfer sheets P, constituting recording materials and stacked in a sheet cassette 20, are separated one by one by a sheet feeding roller 21 and a separating pad 22, and fed toward paired registration rollers 23. The toner image is transferred, in the course of passing the position of a transfer roller 24, in succession onto a transfer sheet P supplied between the transfer roller 24 and the drum 1 under a timing regulated by the registration rollers 23.

The transfer from the drum 1 to a surface of the transfer sheet P is achieved by charging a rear surface of the transfer sheet P with the transfer roller 24 in a polarity opposite to the charge polarity of the toner image. Then the transfer sheet P is subjected to a charge elimination by a charge eliminating needle 25 receiving a voltage of a polarity opposite to that of the transfer roller 24, then separated from the drum 1 and conveyed to a fixing apparatus 8.

In the fixing apparatus 8, the toner T on the transfer sheet P is fused by heating and fixed as a permanent image on the transfer sheet P.

(2) Fixing Apparatus (Image Heating Apparatus) 8

Figure 15:
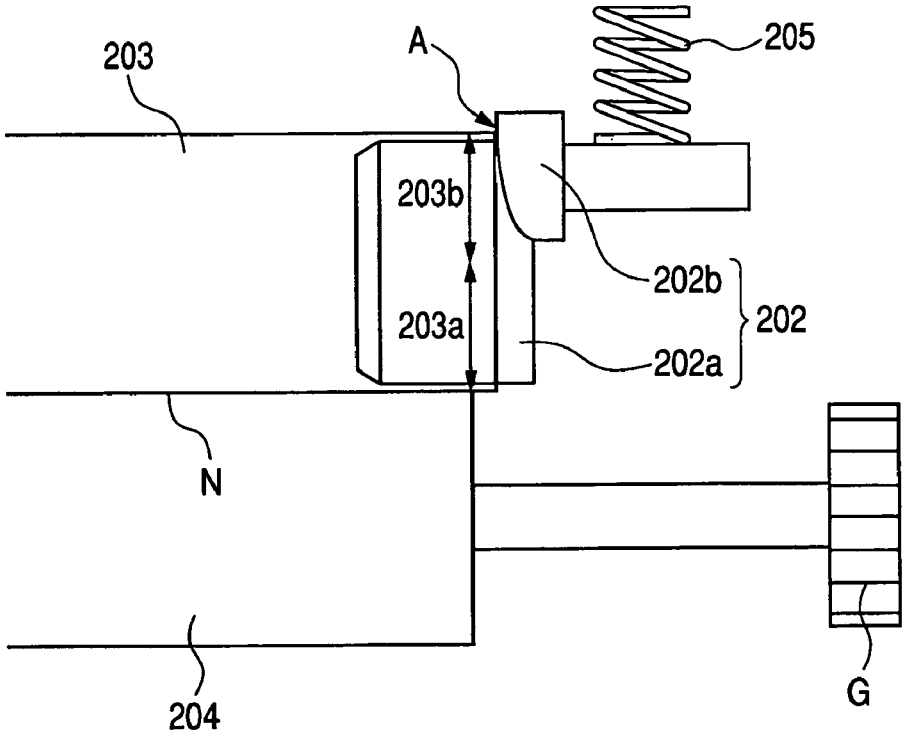
FIG. 15 is a view showing a configuration of a fixing apparatus.

FIG. 15 is an elevation view showing a part of a fixing apparatus in the present embodiment. An endless belt-shaped (cylindrical) fixing film 203, constituting a flexible rotary sleeve, is formed by a single-layered fixing film having a heat-resistant property, a toner releasing property and a tenacity, or a composite film having a desired surface treatment or a lamination. For example, there can be utilized a composite-layered film employing polyester (PET) or polyimide (PI) of a thickness of about 50 μm, made heat-resistant, or a metal sleeve made of thin stainless steel as a substrate layer and forming thereon a releasing layer with PTFE or PFA.

Such fixing film (flexible sleeve) 203 is loosely fitted around a film guide 201 (FIG. 14) and does not show a tension except in the fixing nip portion N at least in a stopped state.

A pressure roller (driving roller) 204 is driven by an unillustrated drive source through a gear G, and the fixing film 203 executes a rotary motion only by a frictional force with the pressure roller 204 at the fixing nip portion N.

A heater (ceramic heater: slidable member) 200 maintained in contact with a film guide member 201 for guiding the internal surface of the fixing film 203 over the entire longitudinal direction and the pressure roller 204 are mutually pressed across the fixing film 203 under a predetermined contact pressure (for example a total pressure of 10-15 kgf in the width of A4 size) by a pressurizing spring 205 thereby forming a fixing nip portion N. On the surface of the heater 200, there is provided a line-shaped or stripe-shaped thin film heat-generating resistor of $TaSiO_2$, silver-palladium, $Ta_2N$, $RuO_2$ or nickel-chromium, formed by evaporation, sputtering, CVD or screen printing.

Also on both edges of the fixing-film 203 in the thrust direction, edge holders (restricting members) 202 are fitted for restricting a rotating trajectory of the fixing film 203 and the edges thereof in the thrust direction. A sliding contact of the external peripheral surface 202*a* of the edge holder 202 and the internal peripheral surface of the fixing film 203 restricts the trajectory of the fixing film 203 in the rotating direction, and a film edge restricting face 202*b* restricts the film edge, as the fixing film 203 when moved in the thrust direction impinges on the film edge restricting face 202*b*.

The present embodiment is characterized in that the fixing film edge restricting face 202*b* of the edge holder 202 is not provided within an area (first area) of the fixing film 203 at a side 203*a* of the fixing nip portion (lower side of the fixing film 203 in FIG. 15), but in an area (second area) corresponding to an opposite side 203*b*. Also the fixing film edge restricting face 202*b* has such a rounded shape in the rotational direction of the fixing film, as shown in FIG. 15, that a gap between the edge of the fixing film 203 in the thrust direction and the edge restricting face 202*b* is smallest at a side opposite to the fixing nip portion N and gradually increases from such position to the upstream and downstream directions.

In the configuration of the present embodiment, in the above-described assembled state, the fixing film 203 when moved in the thrust direction impinges at an edge thereof on a top portion A of the restricting face 202*b*, namely a position most distant from the nip N. When the edge plane of the fixing film in a mounted state on the apparatus is bisected by an imaginary plane substantially parallel to the nip plane of the nip portion N into a first area closer to the nip portion N and a second area farther from the nip portion N, such top portion A is present within the second area.

Figure 16:
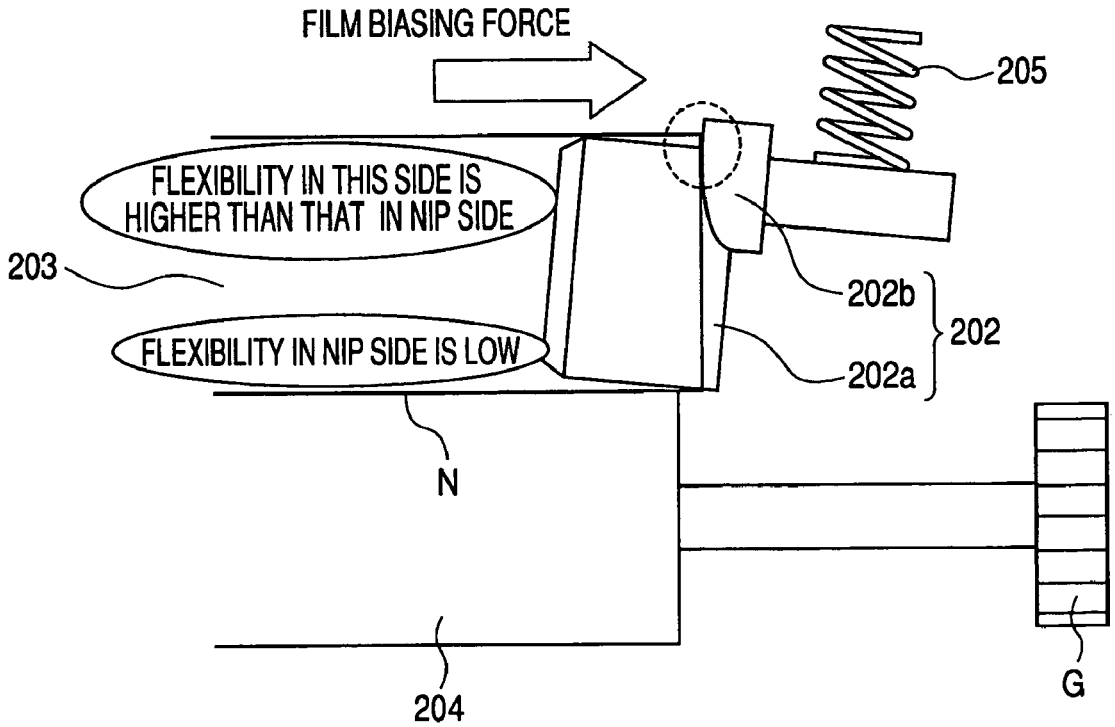
FIG. 16 is a schematic view showing a film movement in case a flange is inclined outwards.

FIG. 16 shows a state in which the fixing film 203 is moved in a state where the edge holder 202 is inclined to the external side by an assembling tolerance.

A movement of the fixing film occurs in case components (particularly heater 200 and pressure roller 204) are not precise in positions or dimensions thereof, in case a conveying power for the fixing film 203 is not uniform over the width thereof for example by a temperature distribution over the width of the heater, or in case the fixing film has an insufficient precision (film thickness, cylindricality etc.).

By thus generated biasing force, the fixing film 203 gradually moves in the thrust direction, and impinges on the restricting face 202*b* of the edge holder 202.

In a prior edge holder, the impingement takes place at the side of the fixing nip portion N (side 203*a*: first area) in case the film edge restricting face 202*b* is inclined to the external side. In the present embodiment, however, as the edge restricting face 202*b* is provided only in the opposite side (side 203*b*: second area) to the fixing nip portion N, the edge of the fixing film 203 does not impinge at the side 203*a* even in case the restricting face 202*b* is inclined to the external side. Also the restricting face 202*b*, having a rounded shape along the rotational direction, can disperse the impinging force which is localized in the prior configuration.

A breakage in the film edge is principally caused, as explained before, by a fact that the flexibility of the film itself tends to be lost in an area close to the nip portion in which the film is nipped, and the film edge impinges on the restricting face of the edge holder in such area to cause a strong stress on the film edge.

In the configuration of the present embodiment, as the film edge-is restricted in an area which is farthest from the nip portion and in which the film remain flexible, a strong stress is not applied to the film edge even when the film edge impinges on the restricting face by the biasing force, whereby a large margin can be secured against the breakage of the film edge.

Embodiment 3

In the present embodiment, the edge holder constituting restriction means for the fixing film in the thrust direction is so formed as to restrict an external peripheral surface of the fixing film. Configurations other those explained in the foregoing are same as those in the foregoing embodiments and will not be explained further.

Figure 17B:
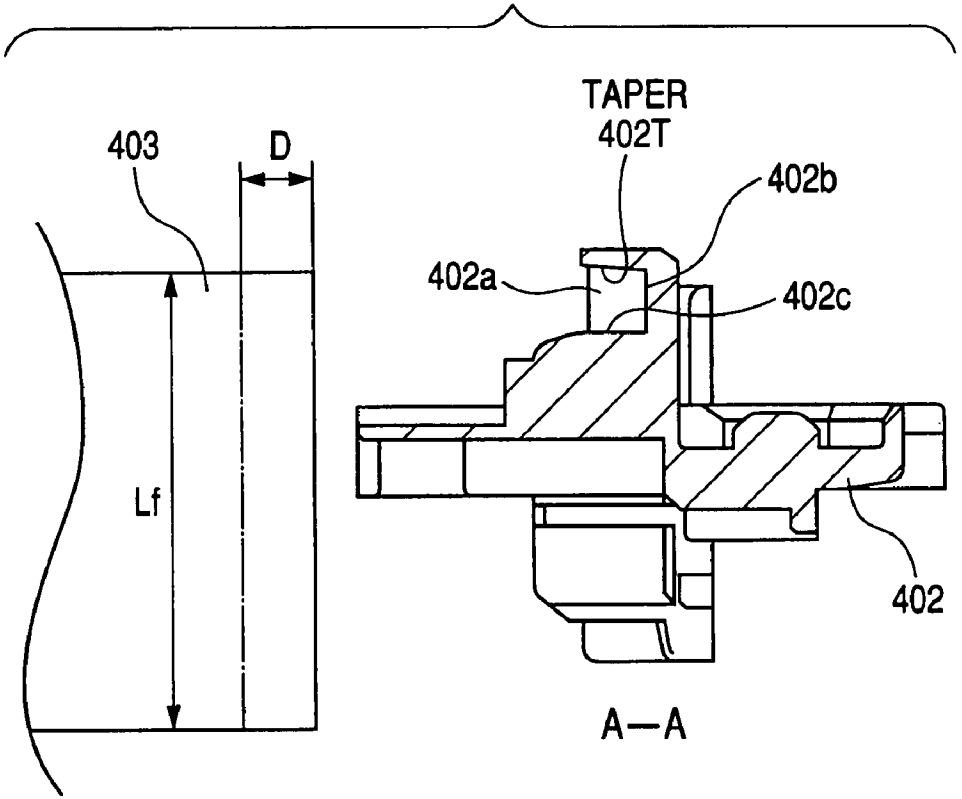
FIGS. 17A and 17B are schematic views showing the configuration of a fixing flange in an embodiment 3.
Figure 17A:
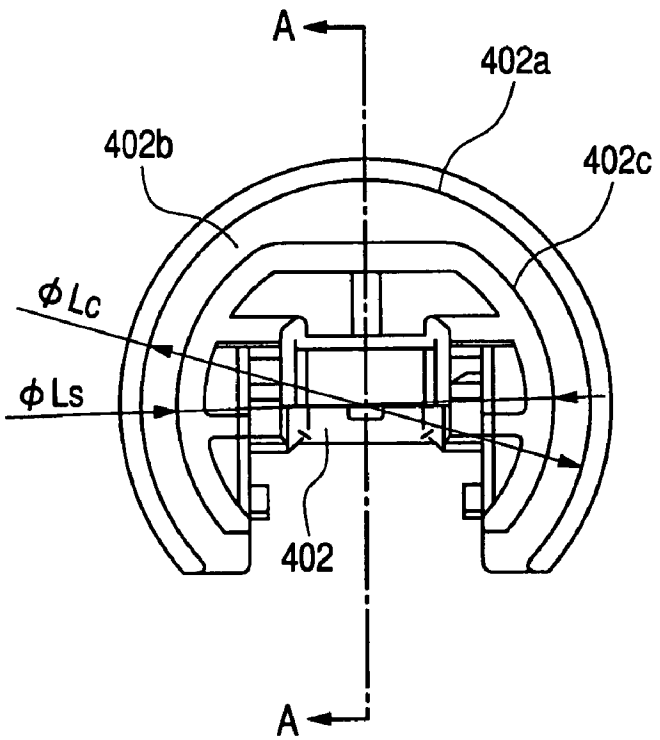

FIGS. 17A and 17B are schematic views of an edge holder 402 and a fixing film 403 of a fixing apparatus (image heating, apparatus) in the present embodiment, wherein FIG. 17A is an elevation view of the edge holder 402, and FIG. 17B is a cross-sectional view thereof with an edge portion of the fixing film 403. As shown in FIG. 17B, the fixing film 403 has, on an external periphery of an edge portion, a portion (width D) for contacting an internal peripheral surface 402*a* of the edge holder, and the fixing film 403 has a diameter Lf.

The edge holder 402 is formed with a heat-resistant resin such as liquid crystal polymer or phenolic resin, and has an inserting portion 402*a* of an internal diameter ϕLc in which the external periphery D of the edge portion of the fixing film 403 can be inserted. Thus, the portion D of the fixing film 403 is inserted into the inserting portion 402*a* of the internal diameter Lc of the edge holder 402, and the edge of the fixing film 403 impinges on the thrust restricting face 402*b* of the edge holder 402.

The inserting portion 402*a* has a tapering 402T of about 3 to 7°, by which the outermost edge of the fixing film 403 moves always in contact with the inserting portion 402*a* and assumes a converging conical shape under a force toward the center of the fixing film 403, whereby the fixing film 403 is restricted in the thrust direction by the impinging portion 402*b* without a fissuring force on the edge of the fixing film 403.

Thus, the tapering 402T provided on the inserting portion 402*a* of the edge holder 402 can prevent a destruction of the edge of the fixing film 403.

Also at the inside of the edge holder 402, there is provided a restricting portion 402*c* of a diameter ϕLs. The diameter ϕLs of the restricting portion 402*c* is selected larger than an external diameter Lg of a heater holder (not shown). The diameter ϕLs of the restricting portion 402*c* is so selected as not to contact the internal periphery of the fixing film 403 in the course or rotation thereof, and not to cause a breakage or a permanent deformation of the fixing film 403 even in case the fixing film 403 contacts such fixing film deformation restricting portion 402*c* by any external force. The aforementioned relation of the diameters can be represented as Lc>Ls>Lg.

Figure 18:
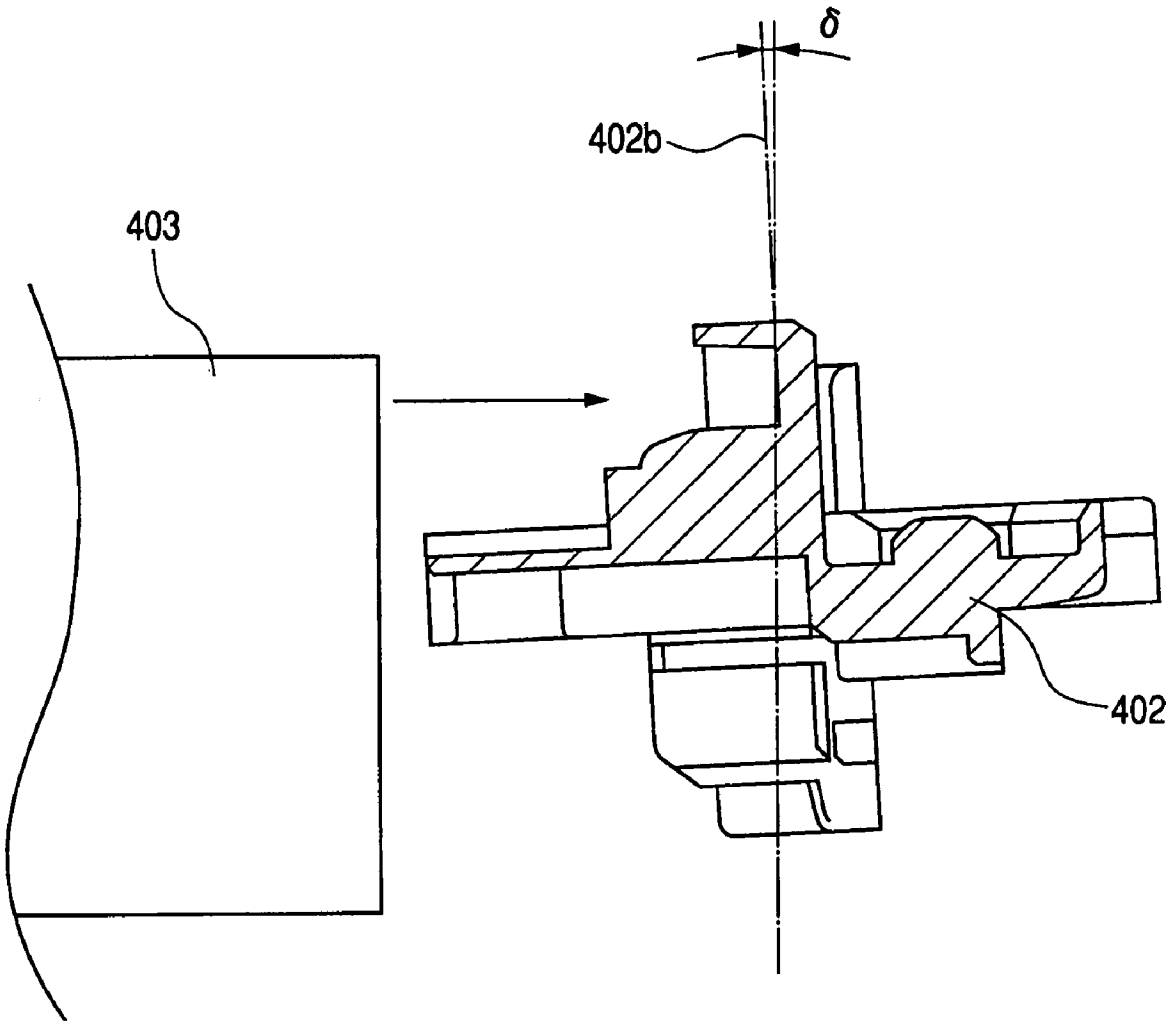
FIG. 18 is a cross-sectional view of a fixing flange.
Figure 19:
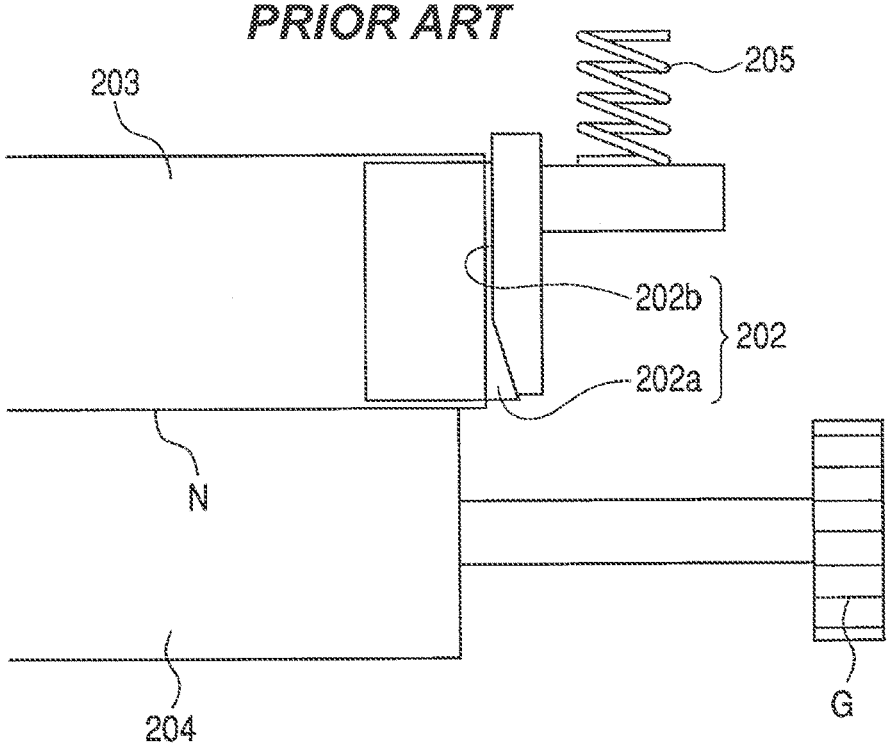
FIG. 19 PRIOR ART
FIG. 19 is a view showing a fixing apparatus in a prior configuration.

The present embodiment is characterized in that the film edge thrust restricting face 402*b* of the edge holder 402 is not provided within an area (first area) of the fixing film 403 at a side of the fixing nip portion, but in an area (second area) corresponding to an opposite side. As shown in FIG. 18, the edge holder 402 formed with an angle δ of 0 to 5°, and such angle allows to form the thrust restricting face 402*b* only in a side (second area) farther from the fixing nip portion N. Such angle δ can also be realized by inclining the thrust restricting face 402*b* only.

In the configuration of the present embodiment, when the fixing film 403 is moved in the thrust direction in the above-described assembled state, the impingement of the edge of the fixing film 403 takes place in a position farthest from the fixing nip portion N, and the movement of the fixing film 403 is restricted in such position.

A breakage in the film edge is principally caused, as explained before, by a fact that the flexibility of the film itself tends to be lost in an area close to the nip portion in which the film is nipped, and the film edge impinges on the restricting face of the edge holder in such area to cause a strong stress on the film edge.

In the configuration of the present embodiment, as the film edge is restricted in an area which is farthest from the nip portion and in which the film remain flexible, a strong stress is not applied to the film edge even when the film edge impinges on the restricting face by the biasing force, whereby a large margin can be secured against the breakage of the film edge.

The edge holder constituting the thrust direction restricting means for the fixing film, of a type for restricting the external peripheral surface of the fixing film as in the present embodiment, is also applicable to the second embodiment shown in FIG. 15, by changing the internal periphery restriction to the external periphery restriction.

In the foregoing embodiments, the slidable member forming the nip portion in cooperation with the pressure roller is a heater, but the member constituting the nip portion need not necessarily have a heat-generating function as long as it has a slidable property.

The present invention has been explained by embodiments thereof, but the invention is not limited to such embodiments and is subject to any and all modifications within the technical concept thereof.

1) The image heating apparatus of the invention is not limited to the use as an image heat fixing apparatus described in the embodiments, but is also usable as a temporary fixing apparatus for a temporary fixation of an unfixed image onto a recording material, or a surface modifying apparatus for reheating a recording material bearing a fixed image thereby modifying a surface property such as gloss of the image.
2) The heating means is not limited to a ceramic heater. It can for example be a contact heating member utilizing a nickel-chromium wire, or an electromagnetic induction heating member such as an iron plate. The heating means need not necessarily be positioned at the fixing nip portion (pressed nip portion). There may also be adopted a configuration in which a belt serving as a heating rotary member is heated externally. Also electromagnetic induction heat generation may be executed within a fixing belt itself.
3) The pressure member is not limited to a roller but can also be formed as a rotary endless belt member.

This application claims priority from Japanese Patent Application No. 2004-044504 filed on Feb. 20, 2004, which is hereby incorporated by reference herein.

What is claimed is:

1. An image heating apparatus comprising:

a flexible sleeve;

a driving roller contacting an external periphery surface of said sleeve and serving to rotate said sleeve;

a sliding member contacting an internal periphery surface of said sleeve to form a nip portion in cooperation with said driving roller;

a restricting member for restricting a movement of said sleeve in a generatrix direction of said sleeve; and between the edge face of said sleeve and said restricting member, an annular member rotated by a frictional contact with said sleeve, wherein, within an edge face of said sleeve in a mounted state on the apparatus, equally bisected by an imaginary plane substantially parallel to a nip plane of the nip portion into a first area closer to the nip portion and a second area farther from the nip portion, said restricting member executes a restricting action only on the second area.

2. An image heating apparatus according to claim 1, wherein said restricting member for restricting the second area of the edge face of said sleeve has a sleeve restricting face which is so inclined as to become gradually farther from the edge face of said sleeve from the second area toward the first area.

3. An image heating apparatus according to claim 1, wherein said sleeve has a metal layer.

4. An image heating apparatus according to claim 1, wherein said sliding member is a heater which generates heat by an electric power supply.

* * * * *

UNITED STATES PATENT AND TRADEMARK OFFICE

CERTIFICATE OF CORRECTION

PATENT NO. : 7,242,895 B2
APPLICATION NO. : 11/056975
DATED : July 10, 2007
INVENTOR(S) : Seiji Inada et al.

It is certified that error appears in the above-identified patent and that said Letters Patent is hereby corrected as shown below:

COLUMN 2
Line 64, “a” should read --an--.

COLUMN 4
Line 21, “farther-from” should read --farther from--.

COLUMN 5
Line 31, “yellowing” should read --yellow--.
Line 39, “a intermediate” should read --an intermediate--.
Line 63, “uniformly.” should read --uniformly--.
Line 65, “an” should read --a--.

COLUMN 8
Line 35, “contact” should read --contacted--.

COLUMN 10
Line 47, “restrict” should read --restricts--.
Line 52, “restrict” should read --restricts--.
Line 58, “contact” should read --contacts--.
Line 66, “angle a” should read --angle α--.

COLUMN 11
Line 2, “close” should read --closer--.
Line 41, “hatched area B” should read --hatched area β--.
Line 43, “elongated.” should read --extended.--.

COLUMN 12
Line 2, “same” should read --the same--.

COLUMN 13
Line 55, “thereof” should read --thereof,--.

UNITED STATES PATENT AND TRADEMARK OFFICE

CERTIFICATE OF CORRECTION

PATENT NO. : 7,242,895 B2
APPLICATION NO. : 11/056975
DATED : July 10, 2007
INVENTOR(S) : Seiji Inada et al.

It is certified that error appears in the above-identified patent and that said Letters Patent is hereby corrected as shown below:

COLUMN 14
Line 14, “remain” should read --remains--.
Line 30, “heating,” should read --heating--.
Line 65, “or rotation” should read --of rotation--.

COLUMN 15
Line 9, “formed” should read --is formed--.
Line 28, “remain” should read --remains--.

Signed and Sealed this

Twenty-fourth Day of June, 2008

JON W. DUDAS
*Director of the United States Patent and Trademark Office*